US012808556B2

(12) United States Patent
Mou et al.

(10) Patent No.: US 12,808,556 B2
(45) Date of Patent: Nov. 24, 2026

(54) INDOOR AIR CLEANING SYSTEM

(71) Applicant: Microjet Technology Co., Ltd., Hsinchu (TW)

(72) Inventors: Hao-Jan Mou, Hsinchu (TW); Chin-Chuan Wu, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 649 days.

(21) Appl. No.: 18/243,746

(22) Filed: Sep. 8, 2023

(65) Prior Publication Data

US 2025/0067451 A1 Feb. 27, 2025

(30) Foreign Application Priority Data

Aug. 22, 2023 (TW) ..... 112131534

(51) Int. Cl.

| | |
|---|---|
| ***A61L 9/00*** | (2006.01) |
| ***F24F 8/108*** | (2021.01) |
| ***F24F 8/20*** | (2021.01) |
| ***F24F 11/65*** | (2018.01) |
| ***F24F 11/72*** | (2018.01) |
| *F24F 110/66* | (2018.01) |

(52) U.S. Cl.

CPC ..... *F24F 8/108* (2021.01); *F24F 8/20* (2021.01); *F24F 11/65* (2018.01); *F24F 11/72* (2018.01); *F24F 2110/66* (2018.01)

(58) Field of Classification Search

CPC . A61L 9/00; A61L 9/014; A61L 9/032; A61L 9/20; A61L 2209/11; A61L 2209/14; F24F 8/95; F24F 8/108; F24F 11/006

USPC ..... 422/4–5, 24, 32, 305–306

See application file for complete search history.

(56) References Cited

U.S. PATENT DOCUMENTS

2005/0103327 A1* 5/2005 Lee ..... F24S 10/55 126/643

2021/0372637 A1* 12/2021 Sharma ..... B01D 46/0028

(Continued)

FOREIGN PATENT DOCUMENTS

CN 207113088 U 3/2018

CN 108061343 A 5/2018

(Continued)

*Primary Examiner* — Monzer R Chorbaji

(74) *Attorney, Agent, or Firm* — Birch, Stewart, Kolasch & Birch, LLP

(57) ABSTRACT

An indoor air cleaning system is disclosed and includes at least one gas detector, at least one cleaning device and a cloud computing server. The gas detector is disposed in an indoor space for detecting air pollution and outputting. The cleaning device includes a fan, a filter and a sterilization component. The fan is controlled to guide airflow passing through the filter and the sterilization component. The fan has a specific CADR for generating a directional circular airflow. The cloud computing server receives the air pollution information, stores to database, and intelligently outputs a control command to the cleaning device according to the air pollution information, so that the fan generates the directional circular airflow to guide the air pollution to pass through the filter and the sterilization component multiple times for filtration and sterilization. Consequently, gas state in the indoor space reaches the cleanliness of the clean room classes.

23 Claims, 25 Drawing Sheets

(56) References Cited

U.S. PATENT DOCUMENTS

| | | | |
|---|---|---|---|
| 2022/0120655 | A1 | 4/2022 | Mou et al. |
| 2022/0170661 | A1 | 6/2022 | Bonzani, Jr. |
| 2022/0196277 | A1 | 6/2022 | Mou et al. |
| 2023/0235914 | A1 | 7/2023 | Mou et al. |

FOREIGN PATENT DOCUMENTS

| | | | |
|---|---|---|---|
| EP | 3 581 854 | A1 | 12/2019 |
| EP | 4 015 925 | A1 | 6/2022 |
| JP | 2022-98449 | A | 7/2022 |
| TW | I545297 | B | 8/2016 |
| TW | M607253 | U | 2/2021 |
| TW | 202331161 | A | 8/2023 |
| TW | I811601 | B | 8/2023 |
| TW | I812043 | B | 8/2023 |

* cited by examiner

1

| classifications of clean room | | The maximum permissible number of particles with a particle size larger than the below particle size in per cubic meter (pcs/$m^3$) | | | | | |
|---|---|---|---|---|---|---|---|
| ISO Class Code | Class Code | 0.1 μm | 0.2 μm | 0.3 μm | 0.5 μm | 1 μm | 5 μm |
| ISO1 | class1 | 10 | 2 | | | | |
| ISO2 | class2 | 100 | 24 | 10 | 4 | | |
| ISO3 | class3 | 1000 | 237 | 102 | 35 | 8 | |
| ISO4 | class4 | 10000 | 2370 | 1020 | 352 | 83 | |
| ISO5 | class5 | 100000 | 23700 | 10200 | 3520 | 832 | 29 |
| ISO6 | class6 | 1000000 | 237000 | 102000 | 35200 | 8320 | 293 |
| ISO7 | class7 | 10000000 | 2370000 | 1020000 | 352000 | 83200 | 2930 |
| ISO8 | class8 | 100000000 | 23700000 | 10200000 | 3520000 | 832000 | 29300 |
| ISO9 | class9 | 1000000000 | 237000000 | 102000000 | 35200000 | 8320000 | 293000 |
| | class10 | 10000000000 | 2370000000 | 1020000000 | 352000000 | 83200000 | 2930000 |
| | class11 | 100000000000 | 23700000000 | 10200000000 | 3520000000 | 832000000 | 29300000 |
| | class12 | 1000000000000 | 237000000000 | 102000000000 | 35200000000 | 8320000000 | 293000000 |
| | class13 | 10000000000000 | 2370000000000 | 1020000000000 | 352000000000 | 83200000000 | 2930000000 |
| | class14 | 100000000000000 | 23700000000000 | 10200000000000 | 3520000000000 | 832000000000 | 29300000000 |
| | class15 | 1000000000000000 | 237000000000000 | 102000000000000 | 35200000000000 | 8320000000000 | 293000000000 |
| | class16 | 10000000000000000 | 2370000000000000 | 1020000000000000 | 352000000000000 | 83200000000000 | 2930000000000 |
| | class17 | 100000000000000000 | 23700000000000000 | 10200000000000000 | 3520000000000000 | 832000000000000 | 29300000000000 |
| | class18 | 1000000000000000000 | 237000000000000000 | 102000000000000000 | 35200000000000000 | 8320000000000000 | 293000000000000 |
| | class19 | 10000000000000000000 | 2370000000000000000 | 1020000000000000000 | 352000000000000000 | 83200000000000000 | 2930000000000000 |
| | class20 | 100000000000000000000 | 23700000000000000000 | 10200000000000000000 | 3520000000000000000 | 832000000000000000 | 29300000000000000 |

FIG. 13

INDOOR AIR CLEANING SYSTEM

CROSS-REFERENCE TO RELATED APPLICATION

This application claims priority to Taiwan Patent Application No. 112131534, filed on Aug. 22, 2023. The entire contents of the above-mentioned patent application are incorporated herein by reference for all purposes.

FIELD OF THE INVENTION

The present disclosure relates to an indoor air cleaning system, and more particularly to an indoor air cleaning system suitable for the gas state in the indoor field to reach the cleanliness of cleanroom classes.

BACKGROUND OF THE INVENTION

Suspended particles are solid particles or droplets contained in the air. Since the sizes of the suspended particles are really small, the suspended particles may enter the lungs of human body through the nasal hair in the nasal cavity easily, thus causing inflammation in the lungs, asthma or cardiovascular disease. If other pollutant compounds are attached to the suspended particles, it will further increase the harm to the respiratory system. In recent years, the problem of air pollution is getting worse. In particular, the concentration of particle matters (e.g., PM2.5) is often too high. Therefore, the monitoring to the concentration of the gas suspended particles is taken more and more seriously. However, the gas flows unstably due to variable wind direction and air volume, and the general gas-quality monitoring station is located in a fixed place. Under this circumstance, it is impossible for people to check the concentration of suspended particles in current environment.

Furthermore, in recent years, people pay more attention to the quality of the air around their lives. For example, carbon monoxide, carbon dioxide, volatile organic compounds (VOC), PM2.5, nitric oxide, sulfur monoxide and even the suspended particles contained in the air are exposed in the environment to affect the human health, and even endanger the life seriously. Therefore, the quality of environmental air has attracted the attention of various countries. At present, how to detect the air quality and avoid the harm is a crucial issue that urgently needs to be solved.

In order to confirm the quality of the air, it is feasible to use a gas sensor to detect the air surrounding in the environment. If the detection information is provided in real time to warn the people in the environment, it is helpful of avoiding the harm and facilitates the people to escape the hazard immediately. Thus, it prevents the hazardous gas exposed in the environment from affecting the human health and causing the harm. Therefore, it is a very good application to use a gas sensor to detect the air in the surrounding environment.

Furthermore, it is not easy to control the indoor air quality. In addition to the outdoor air quality, the indoor air-conditioning conditions and the pollution sources are the major factors affecting the indoor air quality. It is necessary to intelligently and quickly detect indoor air pollution sources in various indoor fields, effectively remove the indoor air pollution to form a clean and safe breathing gas state, and monitor indoor air quality in real time anytime, anywhere. Certainly, if the concentration of the suspended particles in the indoor space field is strictly controlled according to the "clean room" standard, it allows to avoid the introduction, generation and retention of suspended particles, and the temperature and humidity in the indoor space field are controlled within the required range. That is to say, the number of suspended particles in the air pollution of the indoor space field is used to distinguish their classifications, and the suspended particles ≥0.5 μm in per one cubic meter are accounted, so as to determine if the indoor space field meets the clean room requirements for safe breathing. In addition, the clean rooms can be divided into two types of: positive pressure and negative pressure. Generally, the positive pressure clean rooms are used in the semiconductor industry, mainly to prevent outdoor dust pollution, and the negative pressure clean rooms are used in hospitals or some biotechnology factories. Due to the fear of bacteria leakage, the indoor air pressure relative to the outdoor air pressure must be negative. However, a large amount of air exchange has to be utilized in both of positive pressure and negative pressure ones to achieve indoor cleanliness, and the installation cost of these clean room equipment is quite expensive. It is difficult for ordinary consumers to accept and implement the above applications in the indoor space field of the home. Therefore, it is a main subject developed in the present disclosure to provide a solution of detecting the indoor air quality and solving the air pollution problem, so that the indoor space field can meet the requirements of the clean room, and the impact and injury of human health caused by the gas hazards in the environment can be avoided.

SUMMARY OF THE INVENTION

One object of the present disclosure is to provide an indoor air cleaning system. By disposing at least one gas detector and at least one cleaning device, the gas detector can monitor and determine the air pollution at any time, and output an air pollution information. Then the cloud computing server receives the air pollution information, stores the air pollution information to an air pollution database, implements artificial intelligence calculation to determine the location of the air pollution position, and issues a control command to the cleaning device for the actuation operation, so that a directional circular airflow is generated, and the air pollution is rapidly guided to pass through the cleaning device multiple times for filtration, complete purification and sterilization. Through the detecting-cleaning prevention effectiveness of locating the air pollution, guiding the air pollution, and complete purifying the air pollution in the indoor field, the gas state of the indoor field can reach a cleanliness of clean room class.

In accordance with an aspect of the present disclosure, an indoor air cleaning system is provided and includes at least one gas detector, at least one cleaning device and a cloud computing server. The at least one gas detector is disposed in an indoor field for detecting air pollution and outputting air pollution information. The at least one cleaning device includes a fan, a filter and a sterilization component. The fan is actuated to guide the air pollution to pass through the filter for filtration, and pass through the sterilization component for sterilization, wherein the fan has a specific clean air delivery rate (CADR) for generating a directional circular airflow, and the filter comprises a high efficiency particulate air (HEPA) filter screen. The cloud computing server receives the air pollution information, stores the air pollution information to a database, and intelligently computes and selects according to the air pollution information to output a control command to the fan of the cleaning device for actuation operation, whereby the fan of the cleaning device generates a directional circular airflow, and the air pollution is rapidly guided to pass through the filter multiple times for filtration and complete purification and through the sterilization component for sterilization, so that gas state in the indoor field reaches a cleanliness of clean room class.

BRIEF DESCRIPTION OF THE DRAWINGS

The above contents of the present disclosure will become more readily apparent to those ordinarily skilled in the art after reviewing the following detailed description and accompanying drawings, in which:

FIG. 13 is a schematic diagram showing the classifications of the clean rooms according to the embodiment of the present disclosure.

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
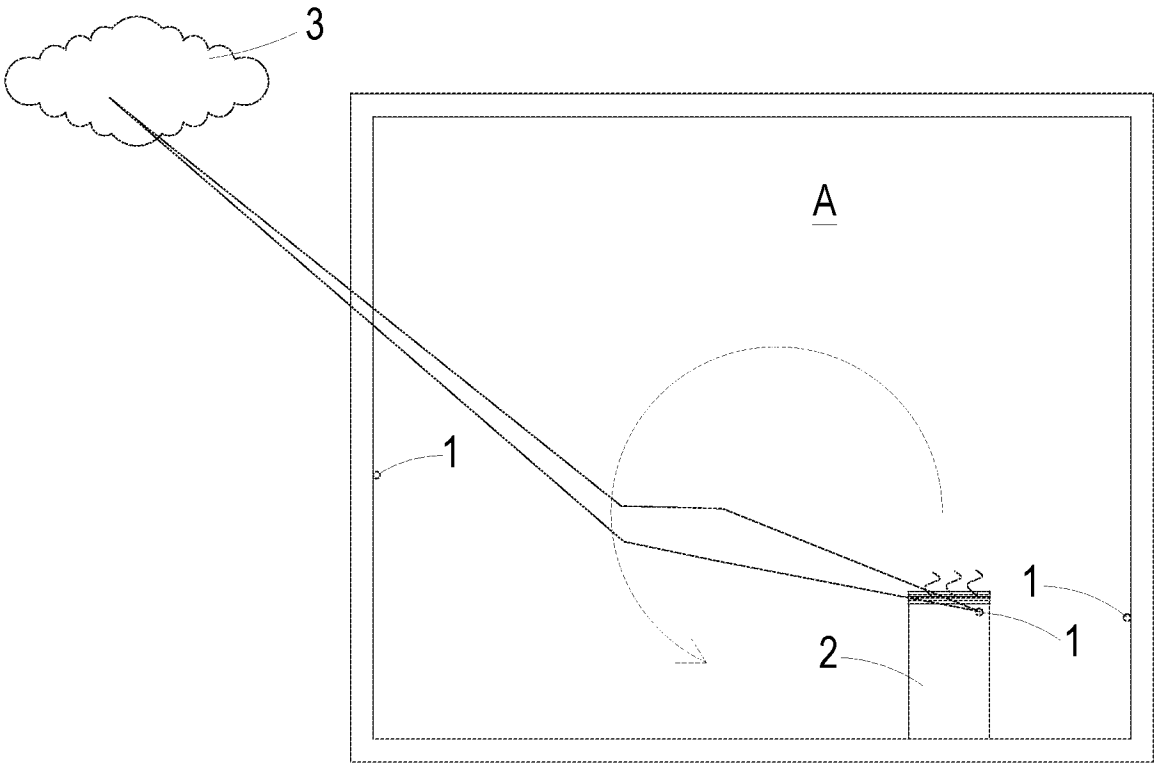
FIG. 1 is a schematic view illustrating an indoor air cleaning system implemented in an indoor field according to an embodiment of the present disclosure.

Please refer to FIG. 1. The present disclosure provides an indoor air cleaning system. The indoor air cleaning system includes at least one gas detector 1, at least one cleaning device 2 and a cloud computing server 3. In the embodiment, the at least one gas detector 1 is disposed in an indoor field A for detecting air pollution and outputting air pollution information. The at least one cleaning device 2 includes a fan 21, a filter 22 and a sterilization component 23. In the embodiment, the fan 21 is controlled and enabled to guide the air pollution to pass through the filter 22 for filtration, and guide the air pollution to pass through the sterilization component 23 for sterilization. Preferably but not exclusively, the filter 22 includes a high efficiency particulate air (HEPA) filter screen. The cloud computing server 3 receives the air pollution information, stores the air pollution information to a database, and intelligently computing (AI computing) and intelligently selecting according to the air pollution information to output a control command to the fan 21 of the cleaning device 2 for actuation operation. Whereby, the fan 21 of the cleaning device 2 generates a directional circular airflow (As shown in the dotted line circulating airflow path in FIG. 1), and the air pollution is rapidly guided to pass through the filter 22 multiple times for filtration and complete purification and through the sterilization component 23 for sterilization. Consequently, the gas state in the indoor field A reaches a cleanliness of clean room class.

Figure 3A:
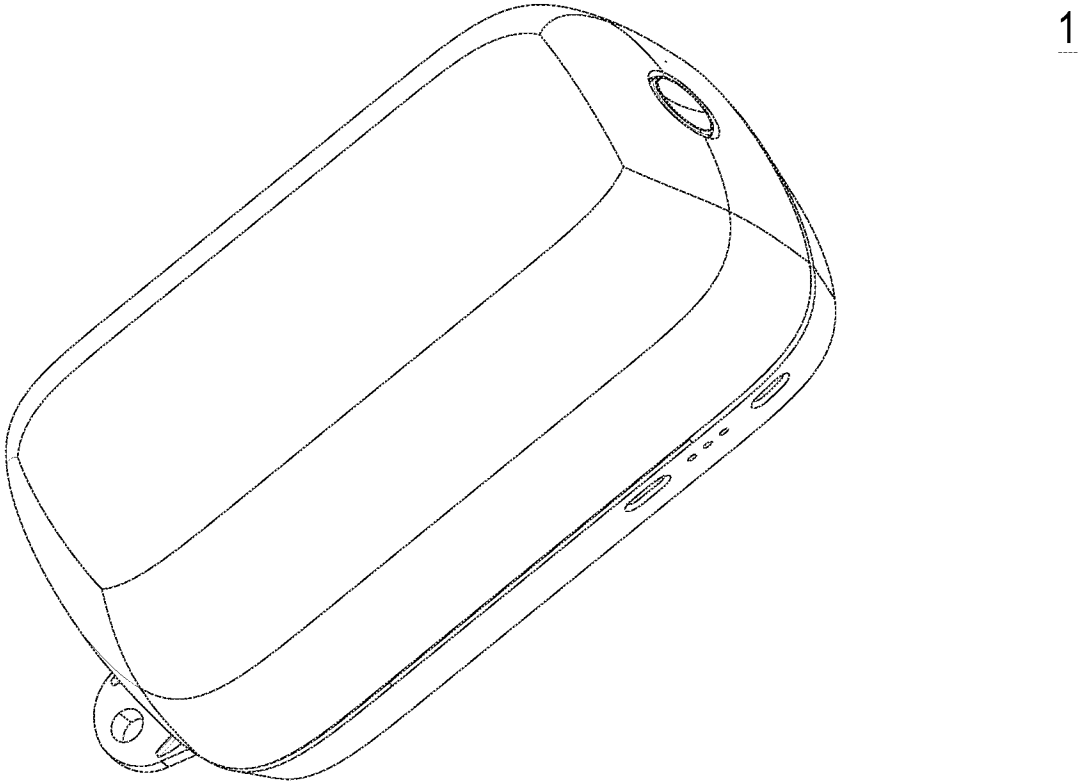
FIG. 3A is a schematic perspective view illustrating the gas detector according to the embodiment of the present disclosure.
Figure 3B:
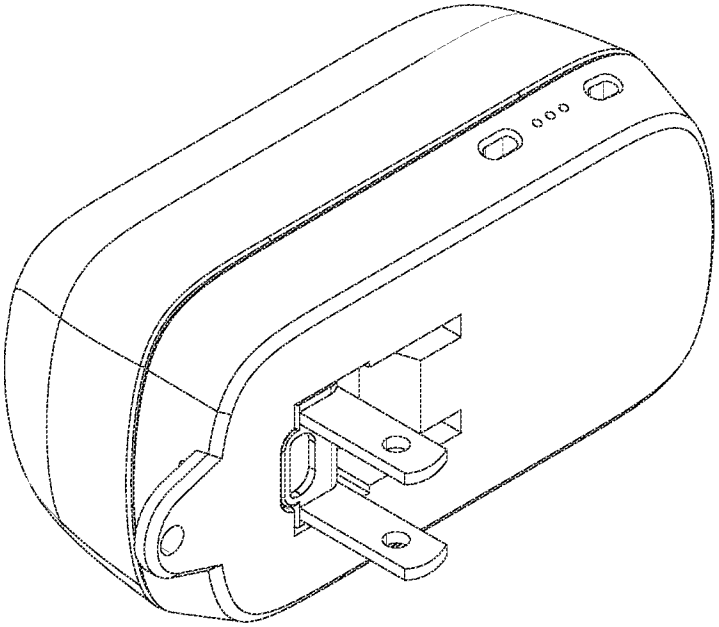
FIG. 3B is a schematic perspective view illustrating the gas detector according to the embodiment of the present disclosure and taken from another perspective.
Figure 3C:
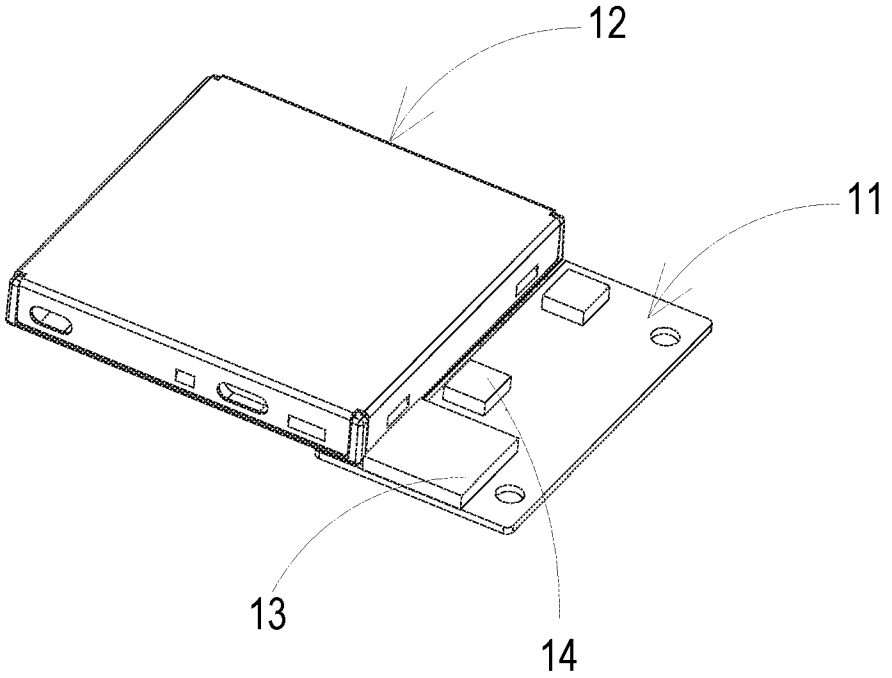
FIG. 3C is a schematic perspective view illustrating the gas detection module installed inside the gas detector according to the embodiment of the present disclosure.
Figure 4A:
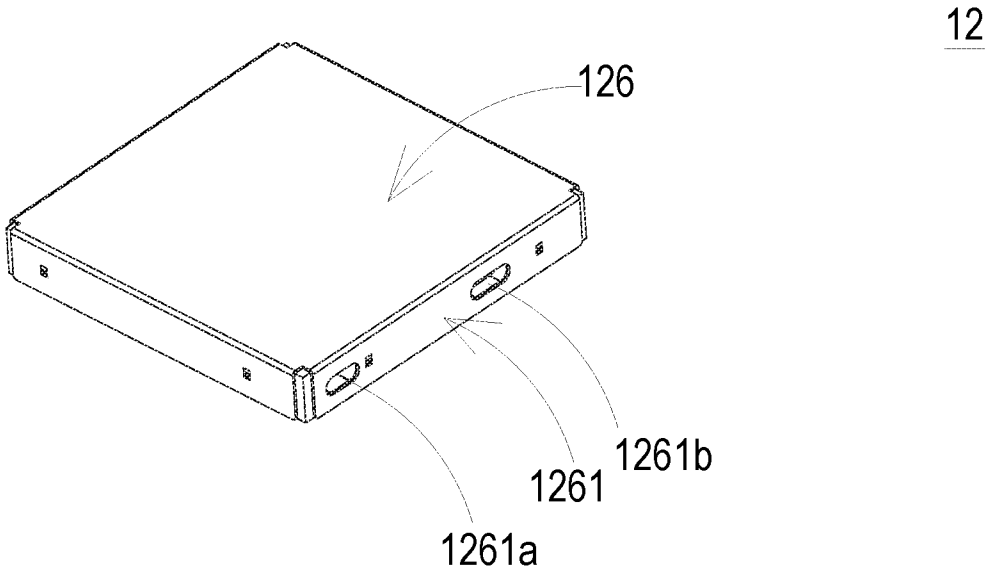
FIG. 4A is a schematic perspective view (1) illustrating the gas detection main part according to the embodiment of the present disclosure.
Figure 4B:
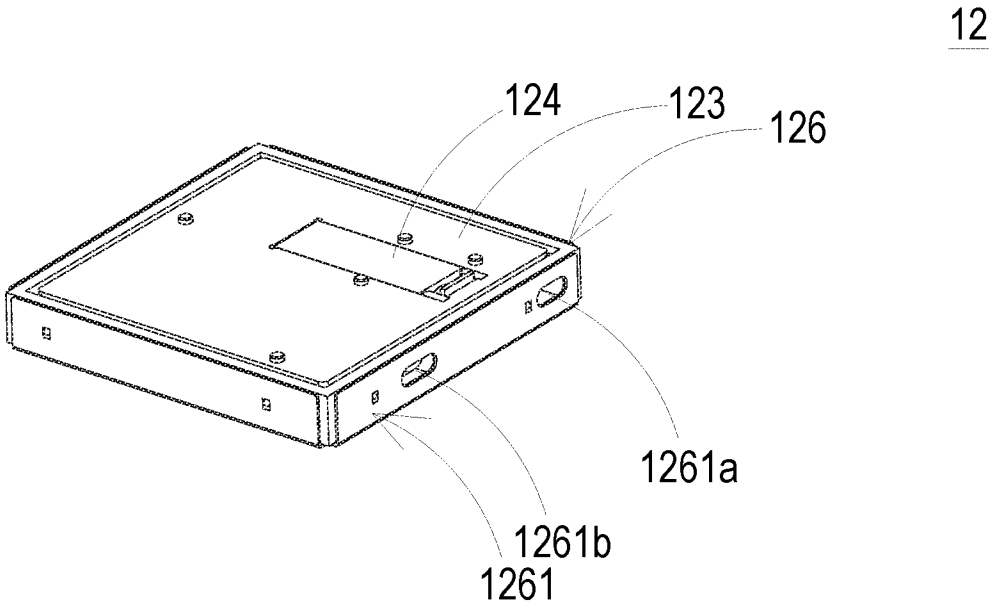
FIG. 4B is a schematic perspective view (2) illustrating the gas detection main part according to the embodiment of the present disclosure.
Figure 4C:
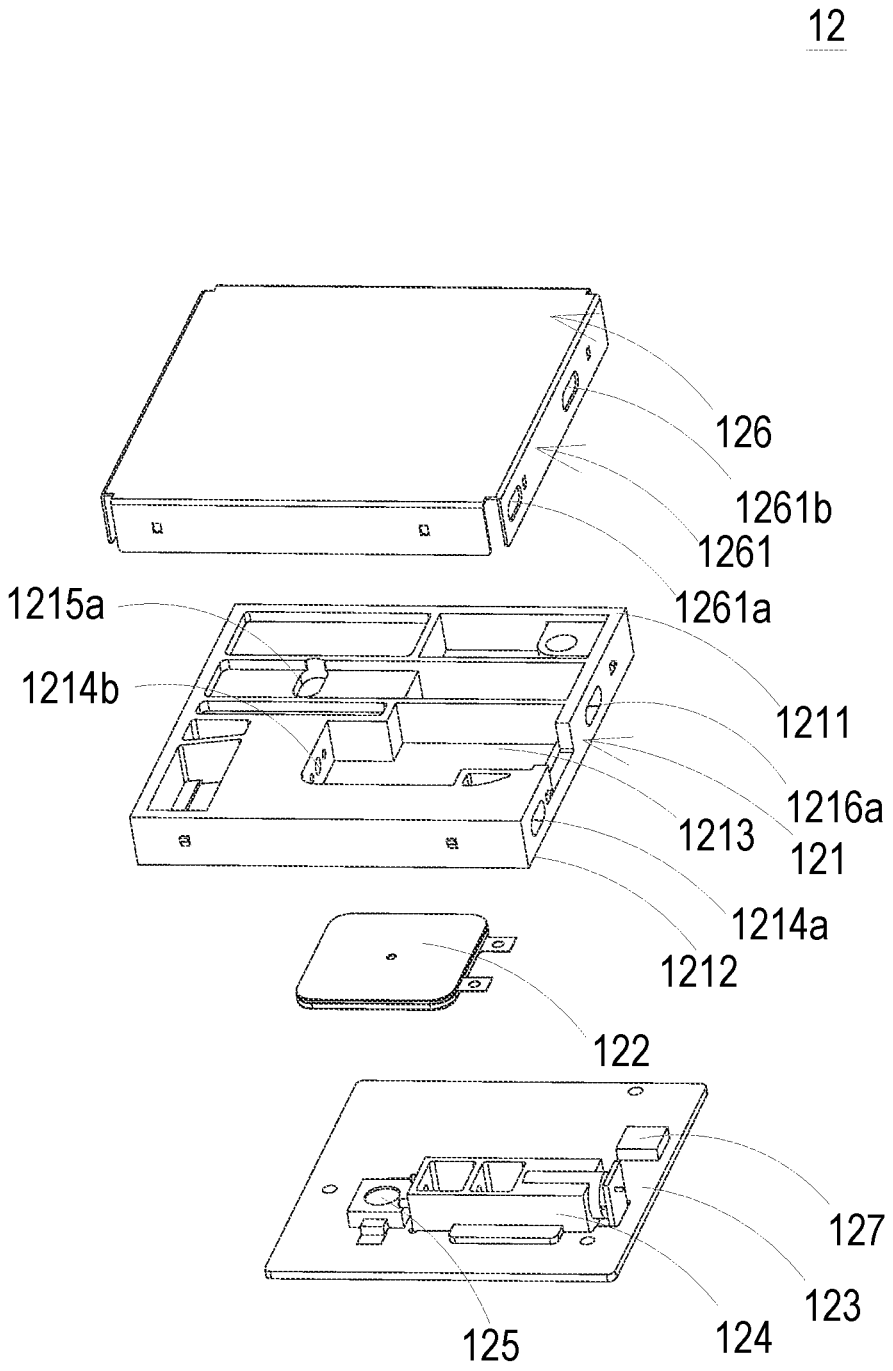
FIG. 4C is an exploded view illustrating the gas detection device according to the embodiment of the present disclosure.
Figure 5A:
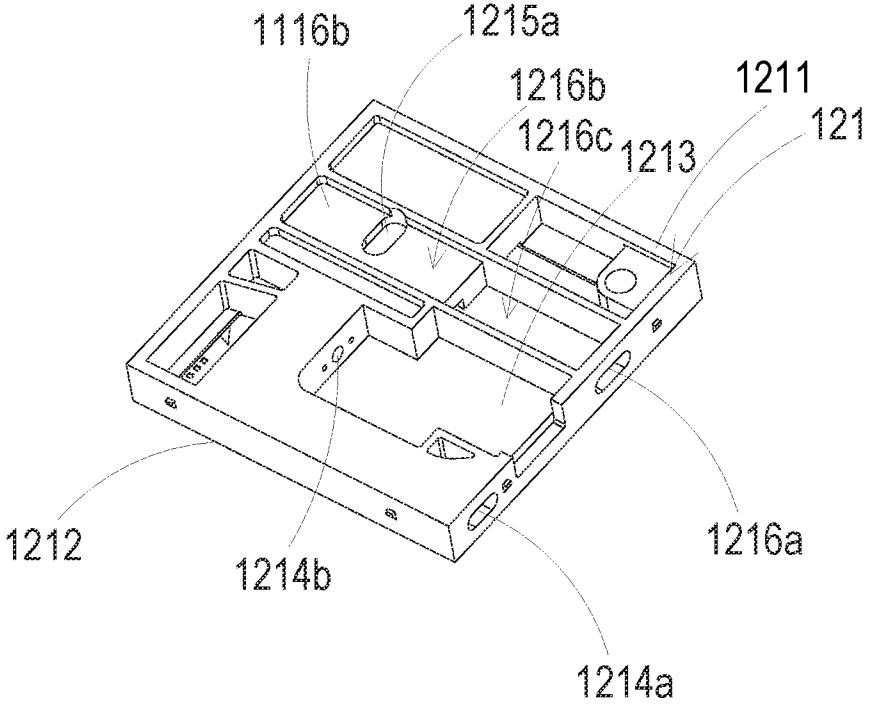
FIG. 5A is a schematic perspective view (1) illustrating the base according to the embodiment of the present disclosure.
Figure 5B:
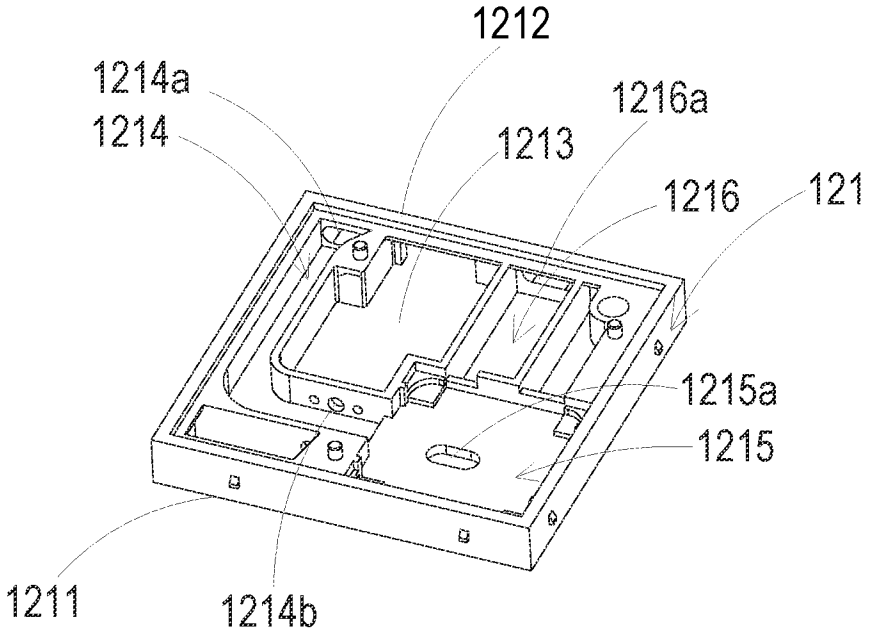
FIG. 5B is a schematic perspective view (2) illustrating the base according to the embodiment of the present disclosure.
Figure 6:
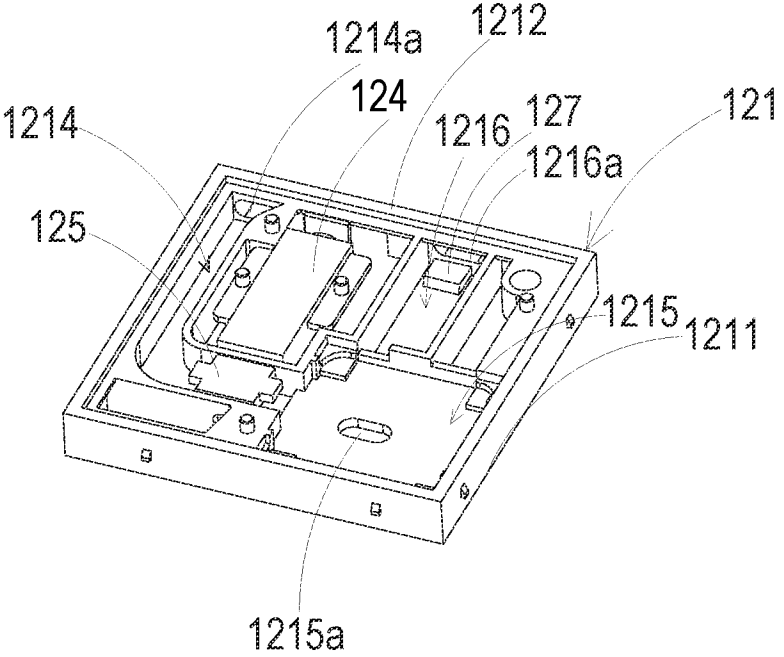
FIG. 6 is a schematic view (3) illustrating the base according to the embodiment of the present disclosure.
Figure 7A:
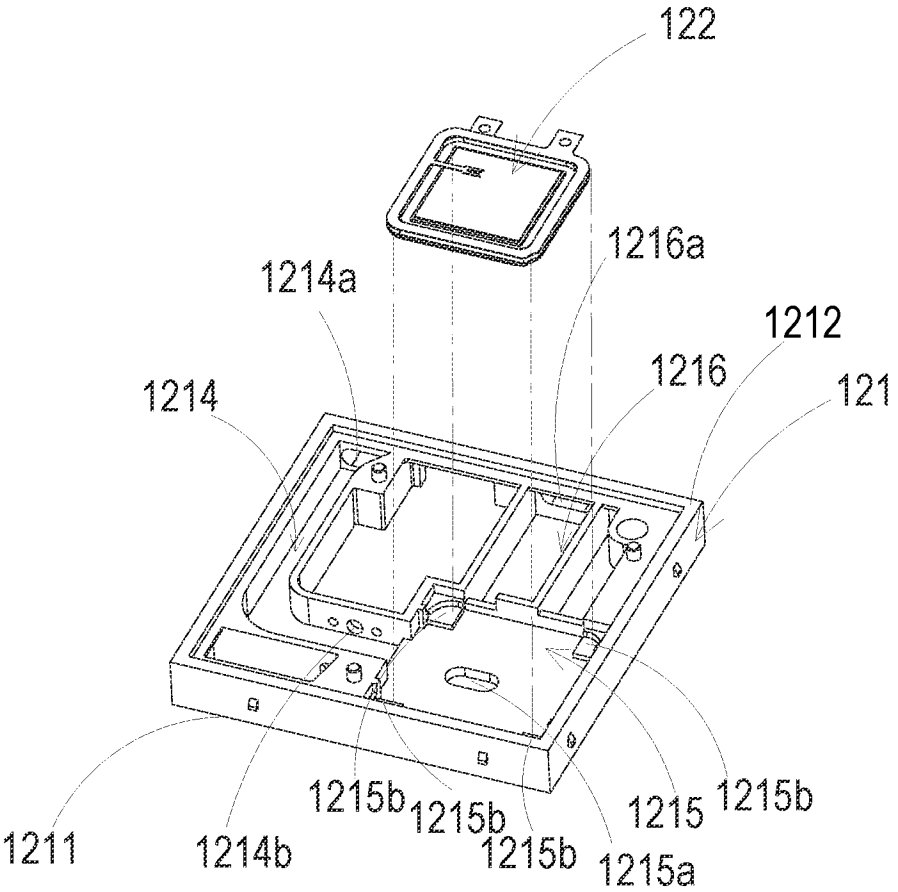
FIG. 7A is a schematic exploded view illustrating the combination of the piezoelectric actuator and the base according to the embodiment of the present disclosure.
Figure 7B:
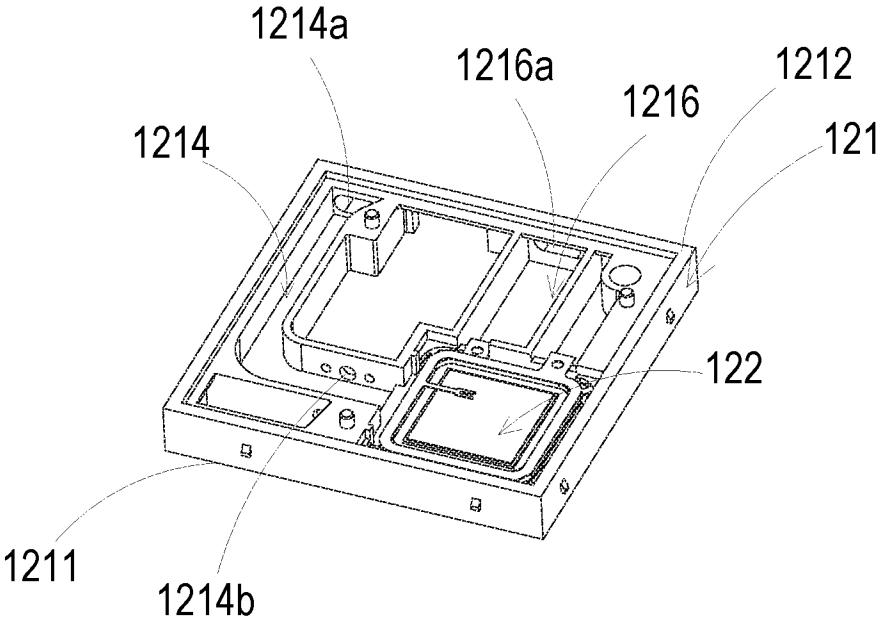
FIG. 7B is a schematic perspective view illustrating the combination of the piezoelectric actuator and the base according to the embodiment of the present disclosure.
Figure 8A:
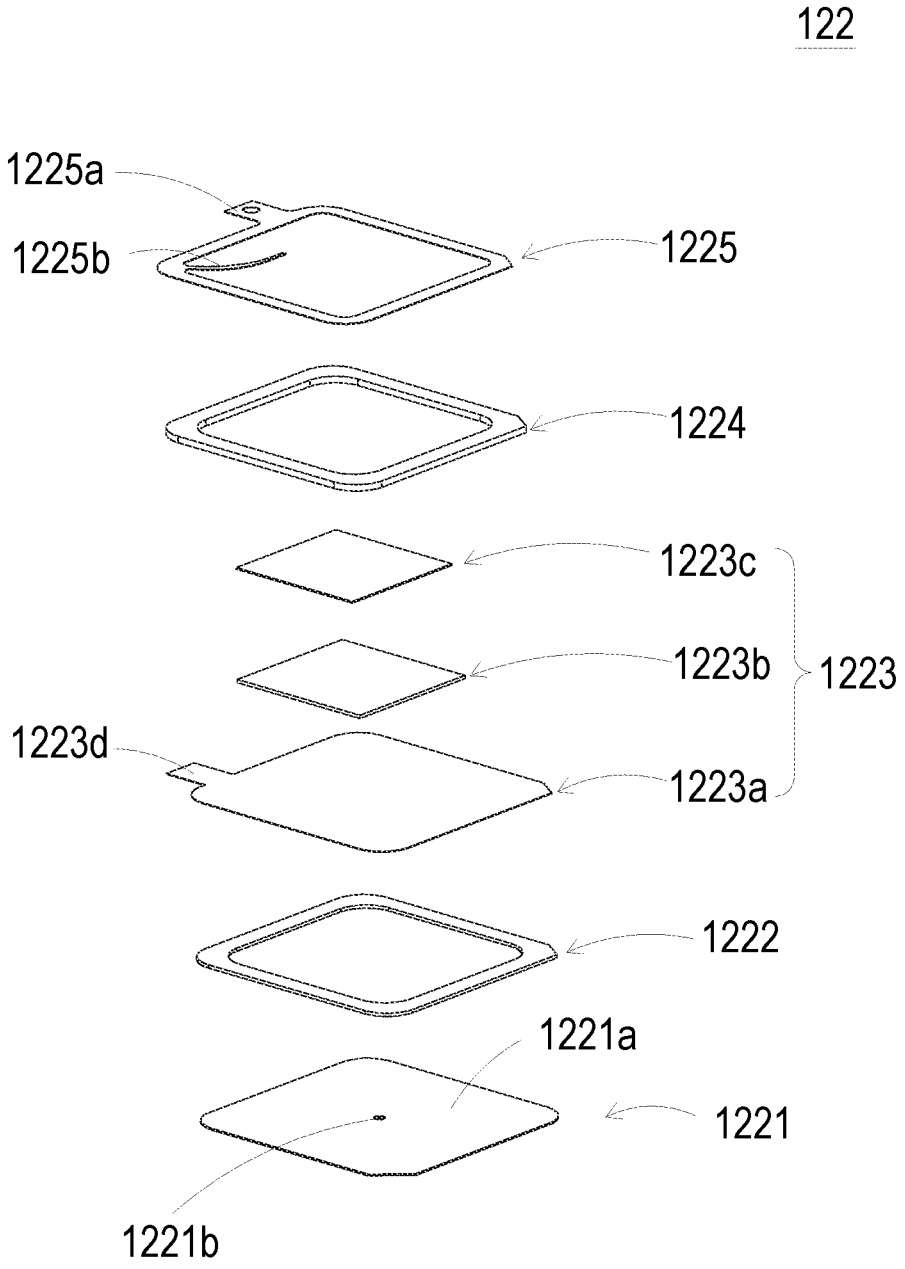
FIG. 8A is a schematic exploded view (1) illustrating the piezoelectric actuator according to the embodiment of the present disclosure.
Figure 8B:
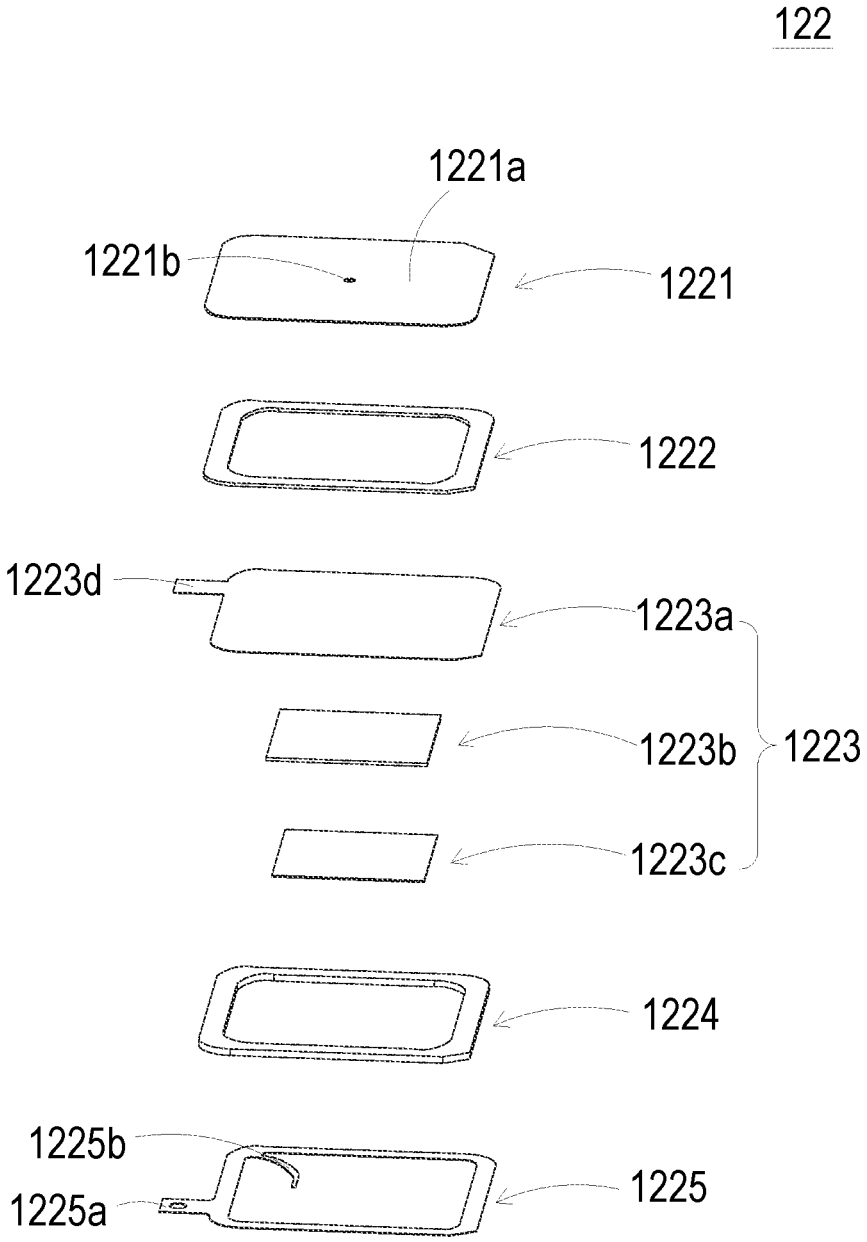
FIG. 8B is a schematic exploded view (2) illustrating the piezoelectric actuator according to the embodiment of the present disclosure.

In the embodiment, the gas detector 1 is disposed in the indoor field A for detecting the air pollution and outputting the air pollution information. Preferably but not exclusively, the gas detector 1 includes a gas detection module installed therein. Notably, please refer to FIG. 3A and FIG. 3B. The gas detector 1 can be configured with an external power terminal, and the external power terminal can be directly inserted into the power interface in the indoor field A for actuating the operation and detecting the air pollution. Alternatively, as shown in FIG. 3C, the gas detection module without external power supply terminals is directly disposed on the device (the cleaning device 2), and connected to the power supply for actuating the operation and detecting the air pollution. Notably, in the embodiment, the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

The structure of the gas detection module of the gas detector 1 of the present disclosure is described in detail below. Please refer to FIG. 3A to FIG. 11. In the embodiment, the gas detection module includes a controlling circuit board 11, a gas detection main part 12, a microprocessor 13 and a communicator 14. The gas detection main part 12, the microprocessor 13 and the communicator 14 are integrally packaged on the controlling circuit board 11 and electrically connected to each other. In the embodiment, the microprocessor 13 and the communicator 14 are mounted on the controlling circuit board 11. The microprocessor 13 controls the driving signal of the gas detection main part 12 for enabling the detection. In this way, the gas detection main part 12 detects the air pollution and outputs the air pollution information, and the microprocessor 14 receives, processes and provides the air pollution information to the communicator 14 for a communication transmission externally, and transmitting to the cloud computing server 3. In the embodiment, the communication transmission is a wireless communication transmission. Preferably but not exclusively, the wireless communication transmission is one selected from the group consisting of a Wi-Fi communication transmission, a Bluetooth communication transmission, a radio frequency identification communication transmission and a near field communication (NFC) transmission. In this way, the communicator 14 of the gas detection module communicates with the cloud computing server 3 through the Internet of Things (IOT).

Please refer to FIG. 4A to FIG. 9A. In the embodiment, the gas detection main part 12 includes a base 121, a piezoelectric actuator 122, a driving circuit board 123, a laser component 124, a particulate sensor 125, and an outer cover 126. In the embodiment, the base 121 includes a first surface 1211, a second surface 1212, a laser loading region 1213, a gas-inlet groove 1214, a gas-guiding-component loading region 1215 and a gas-outlet groove 1216. The first surface 1211 and the second surface 1212 are two surfaces opposite to each other. In the embodiment, the laser loading region 1213 is hollowed out from the first surface 1211 toward the second surface 1212. The outer cover 126 covers the base 121 and includes a side plate 1261. The side plate 1261 has an inlet opening 1261*a* and an outlet opening 1261*b*. The gas-inlet groove 1214 is concavely formed from the second surface 1212 and disposed adjacent to the laser loading region 1213. The gas-inlet groove 1214 includes a gas-inlet 1214*a* and two lateral walls. The gas-inlet 1214*a* is in communication with an environment outside the base 121, and is spatially corresponding in position to an inlet opening 1261*a* of the outer cover 126. Two transparent windows 1214*b* are opened on the two lateral walls of the gas-inlet groove 1214 and are in communication with the laser loading region 1213. Therefore, the first surface 1211 of the base 121 is covered and attached by the outer cover 126, and the second surface 1212 is covered and attached by the driving circuit board 123, so that an inlet path is defined by the gas-inlet groove 1214.

In the embodiment, the gas-guiding-component loading region 1215 mentioned above is concavely formed from the second surface 1212 and in communication with the gas-inlet groove 1214. A ventilation hole 1215*a* penetrates a bottom surface of the gas-guiding-component loading region 1215. The gas-guiding-component loading region 1215 includes four positioning protrusions 1215*b* disposed at four corners of the gas-guiding-component loading region 1215, respectively. In the embodiment, the gas-outlet groove 1216 includes a gas-outlet 1216*a*, and the gas-outlet 1216*a* is spatially corresponding to the outlet opening 1261*b* of the outer cover 126. The gas-outlet groove 1216 includes a first section 1216*b* and a second section 1216*c*. The first section 1216*b* is concavely formed out from the first surface 1211 in a region spatially corresponding to a vertical projection area of the gas-guiding-component loading region 1215. The second section 1216*c* is hollowed out from the first surface 1211 to the second surface 1212 in a region where the first surface 1211 is extended from the vertical projection area of the gas-guiding-component loading region 1215. The first section 1216*b* and the second section 1216*c* are connected to form a stepped structure. Moreover, the first section 1216*b* of the gas-outlet groove 1216 is in communication with the ventilation hole 1215*a* of the gas-guiding-component loading region 1215, and the second section 1216*c* of the gas-outlet groove 1216 is in communication with the gas-outlet 1216*a*. In that, when first surface 1211 of the base 121 is attached and covered by the outer cover 126 and the second surface 1212 of the base 121 is attached and covered by the driving circuit board 123, the gas-outlet groove 1216 and the driving circuit board 123 collaboratively define an outlet path.

In the embodiment, the laser component 124 and the particulate sensor 125 are disposed on and electrically connected to the driving circuit board 123 and located within the base 121. In order to clearly describe and illustrate the positions of the laser component 124 and the particulate sensor 125 in the base 121, the driving circuit board 123 is intentionally omitted. The laser component 124 is accommodated in the laser loading region 1213 of the base 121, and the particulate sensor 125 is accommodated in the gas-inlet groove 1214 of the base 121 and is aligned to the laser component 124. In addition, the laser component 124 is spatially corresponding to the transparent window 1214*b*, therefore, a light beam emitted by the laser component 124 passes through the transparent window 1214*b* and is irradiated into the gas-inlet groove 1214. A light beam path emitted from the laser component 124 passes through the transparent window 1214*b* and extends in an orthogonal direction perpendicular to the gas-inlet groove 1214. In the embodiment, a projecting light beam emitted from the laser component 124 passes through the transparent window 1214*b* and enters the gas-inlet groove 1214 to irradiate the suspended particles contained in the gas passing through the gas-inlet groove 1214. When the suspended particles contained in the gas are irradiated and generate scattered light spots, the scattered light spots are received and calculated by the particulate sensor 125 to obtain the gas detection information.

In the embodiment, the piezoelectric actuator 122 is accommodated in the square-shaped gas-guiding-component loading region 1215 of the base 121. In addition, the gas-guiding-component loading region 1215 of the base 121 is in fluid communication with the gas-inlet groove 1214. When the piezoelectric actuator 122 is enabled, the gas in the gas-inlet groove 1214 is inhaled by the piezoelectric actuator 122, so that the gas flows into the piezoelectric actuator 122, and is transported into the gas-outlet groove 1216 through the ventilation hole 1215*a* of the gas-guiding-component loading region 1215. Moreover, the driving circuit board 123 covers the second surface 1212 of the base 121, and the laser component 124 is positioned and disposed on the driving circuit board 123, and is electrically connected to the driving circuit board 123. The particulate sensor 125 is also positioned and disposed on the driving circuit board 123 and electrically connected to the driving circuit board 123. In that, when the outer cover 126 covers the base 121, the inlet opening 1261*a* is spatially corresponding to the gas-inlet 1214*a* of the base 121, and the outlet opening 1261*b* is spatially corresponding to the gas-outlet 1216*a* of the base 121.

In the embodiment, the piezoelectric actuator 122 includes a gas-injection plate 1221, a chamber frame 1222, an actuator element 1223, an insulation frame 1224 and a conductive frame 1225. In the embodiment, the gas-injection plate 1221 is made by a flexible material and includes a suspension plate 1221*a* and a hollow aperture 1221*b*. The suspension plate 1221*a* is a sheet structure and is permitted to undergo a bending deformation. Preferably but not exclusively, the shape and the size of the suspension plate 1221*a* are accommodated in the inner edge of the gas-guiding-component loading region 1215, but not limited thereto. The hollow aperture 1221*b* passes through a center of the suspension plate 1221*a*, so as to allow the gas to flow therethrough. Preferably but not exclusively, in the embodiment, the shape of the suspension plate 1221*a* is selected from the group consisting of a square, a circle, an ellipse, a triangle and a polygon, but not limited thereto.

In the embodiment, the chamber frame 1222 is carried and stacked on the gas-injection plate 1221. In addition, the shape of the chamber frame 1222 is corresponding to the gas-injection plate 1221. The actuator element 1223 is carried and stacked on the chamber frame 1222. A resonance chamber 1226 is collaboratively defined by the actuator element 1223, the chamber frame 1222 and the suspension plate 1221*a* and is formed between the actuator element 1223, the chamber frame 1222 and the suspension plate 1221*a*. The insulation frame 1224 is carried and stacked on the actuator element 1223 and the appearance of the insulation frame 1224 is similar to that of the chamber frame 1222. The conductive frame 1225 is carried and stacked on the insulation frame 1224, and the appearance of the conductive frame 1225 is similar to that of the insulation frame 1224. In addition, the conductive frame 1225 includes a conducting pin 1225*a* and a conducting electrode 1225*b*. The conducting pin 1225*a* is extended outwardly from an outer edge of the conductive frame 1225, and the conducting electrode 1225*b* is extended inwardly from an inner edge of the conductive frame 1225. Moreover, the actuator element 1223 further includes a piezoelectric carrying plate 1223*a*, an adjusting resonance plate 1223*b* and a piezoelectric plate 1223*c*. The piezoelectric carrying plate 1223*a* is carried and stacked on the chamber frame 1222. The adjusting resonance plate 1223*b* is carried and stacked on the piezoelectric carrying plate 1223*a*. The piezoelectric plate 1223*c* is carried and stacked on the adjusting resonance plate 1223*b*. The adjusting resonance plate 1223*b* and the piezoelectric plate 1223*c* are accommodated in the insulation frame 1224. The conducting electrode 1225*b* of the conductive frame 1225 is electrically connected to the piezoelectric plate 1223*c*. In the embodiment, the piezoelectric carrying plate 1223*a* and the adjusting resonance plate 1223*b* are made by a conductive material. The piezoelectric carrying plate 1223*a* includes a piezoelectric pin 1223*d*. The piezoelectric pin 1223*d* and the conducting pin 1225*a* are electrically connected to a driving circuit (not shown) of the driving circuit board 123, so as to receive a driving signal, such as a driving frequency and a driving voltage. Through this structure, a circuit is formed by the piezoelectric pin 1223*d*, the piezoelectric carrying plate 1223*a*, the adjusting resonance plate 1223*b*, the piezoelectric plate 1223*c*, the conducting electrode 1225*b*, the conductive frame 1225 and the conducting pin 1225*a* for transmitting the driving signal. Moreover, the insulation frame 1224 is insulated between the conductive frame 1225 and the actuator element 1223, so as to avoid the occurrence of a short circuit. Thereby, the driving signal is transmitted to the piezoelectric plate 1223*c*. After receiving the driving signal such as the driving frequency and the driving voltage, the piezoelectric plate 1223*c* deforms due to the piezoelectric effect, and the piezoelectric carrying plate 1223*a* and the adjusting resonance plate 1223*b* are further driven to generate the bending deformation in the reciprocating manner.

Furthermore, in the embodiment, the adjusting resonance plate 1223*b* is located between the piezoelectric plate 1223*c* and the piezoelectric carrying plate 1223*a* and served as a cushion between the piezoelectric plate 1223*c* and the piezoelectric carrying plate 1223*a*. Thereby, the vibration frequency of the piezoelectric carrying plate 1223*a* is adjustable. Basically, the thickness of the adjusting resonance plate 1223*b* is greater than the thickness of the piezoelectric carrying plate 1223*a*, and the vibration frequency of the actuator element 1223 can be adjusted by adjusting the thickness of the adjusting resonance plate 1223*b*.

Please further refer to FIG. 7A, FIG. 7B, FIG. 8A, FIG. 8B and FIG. 9A. In the embodiment, the gas-injection plate 1221, the chamber frame 1222, the actuator element 1223, the insulation frame 1224 and the conductive frame 1225 are stacked and positioned in the gas-guiding-component loading region 1215 sequentially, so that the piezoelectric actuator 122 is supported and positioned in the gas-guiding-component loading region 1215. A plurality of clearances 1221*c* are defined between the suspension plate 1221*a* of the gas-injection plate 1221 and an inner edge of the gas-guiding-component loading region 1215 for gas flowing therethrough. In the embodiment, a flowing chamber 1227 is formed between the gas-injection plate 1221 and the bottom surface of the gas-guiding-component loading region 1215. The flowing chamber 1227 is in communication with the resonance chamber 1226 between the actuator element 1223, the chamber frame 1222 and the suspension plate 1221*a* through the hollow aperture 1221*b* of the gas-injection plate 1221. By controlling the vibration frequency of the gas in the resonance chamber 1226 to be close to the vibration frequency of the suspension plate 1221*a*, the Helmholtz resonance effect is generated between the resonance chamber 1226 and the suspension plate 1221*a*, so as to improve the efficiency of gas transportation. When the piezoelectric plate 1223*c* is moved away from the bottom surface of the gas-guiding-component loading region 1215, the suspension plate 1221*a* of the gas-injection plate 1221 is driven to move away from the bottom surface of the gas-guiding-component loading region 1215 by the piezoelectric plate 1223*c*. In that, the volume of the flowing chamber 1227 is expanded rapidly, the internal pressure of the flowing chamber 1227 is decreased to form a negative pressure, and the gas outside the piezoelectric actuator 122 is inhaled through the clearances 1221*c* and enters the resonance chamber 1226 through the hollow aperture 1221*b*. Consequently, the pressure in the resonance chamber 1226 is increased to generate a pressure gradient. When the suspension plate 1221*a* of the gas-injection plate 1221 is driven by the piezoelectric plate 1223*c* to move toward the bottom surface of the gas-guiding-component loading region 1215, the gas in the resonance chamber 1226 is discharged out rapidly through the hollow aperture 1221*b*, and the gas in the flowing chamber 1227 is compressed, thereby the converged gas is quickly and massively ejected out of the flowing chamber 1227 under the condition close to an ideal gas state of the Benulli's law, and transported to the ventilation hole 1215*a* of the gas-guiding-component loading region 1215.

Figure 9A:
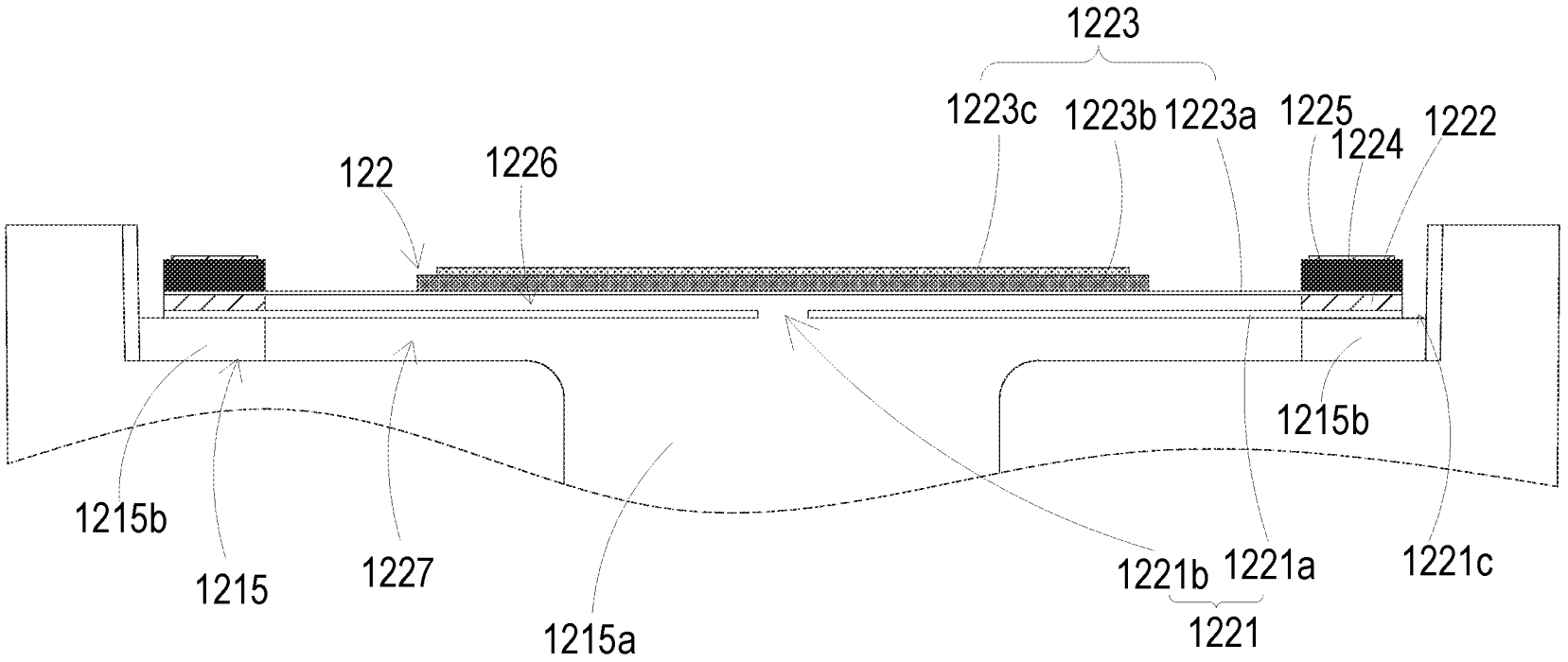
FIG. 9A is a schematic cross-sectional view (1) illustrating an action of the piezoelectric actuator according to the embodiment of the present disclosure.
Figure 9B:
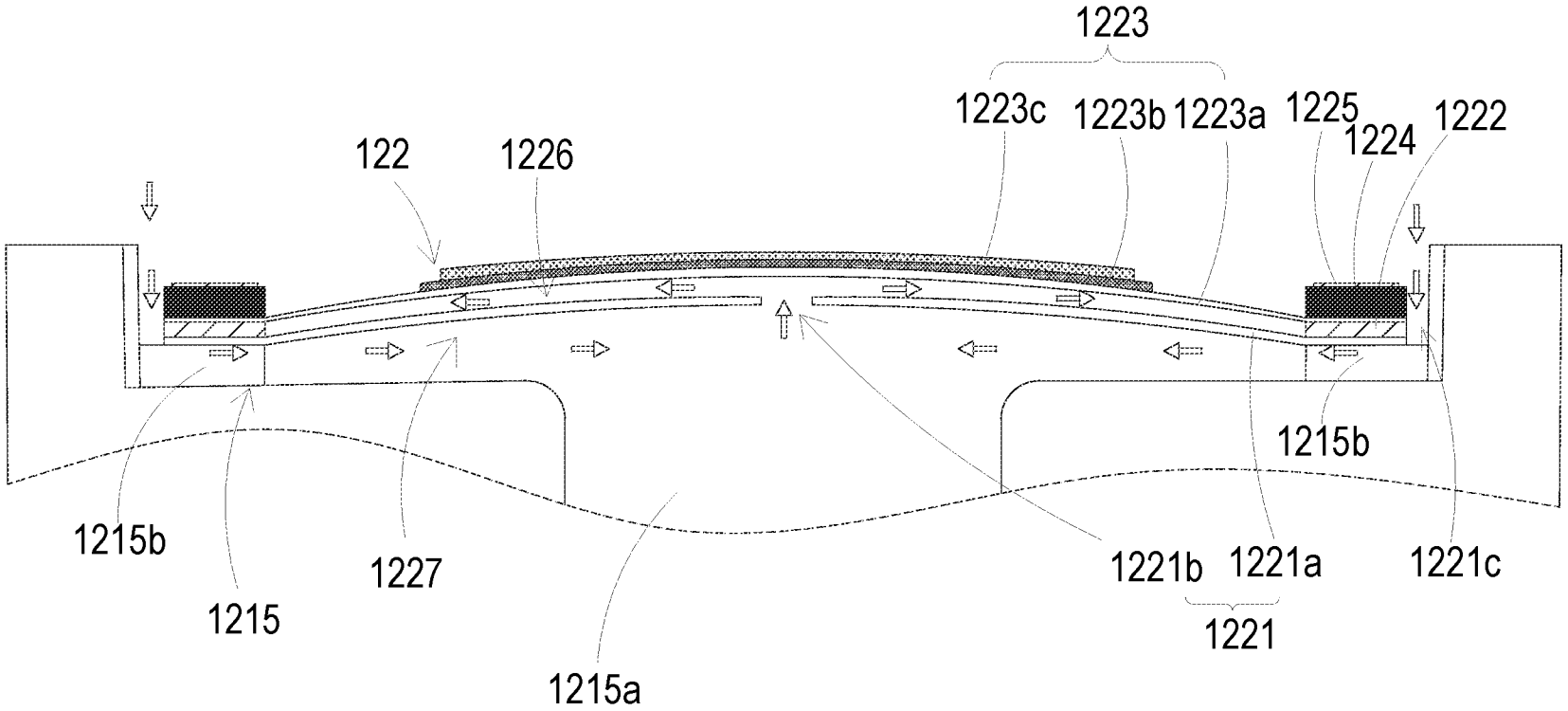
FIG. 9B is a schematic cross-sectional view (2) illustrating an action of the piezoelectric actuator according to the embodiment of the present disclosure.
Figure 9C:
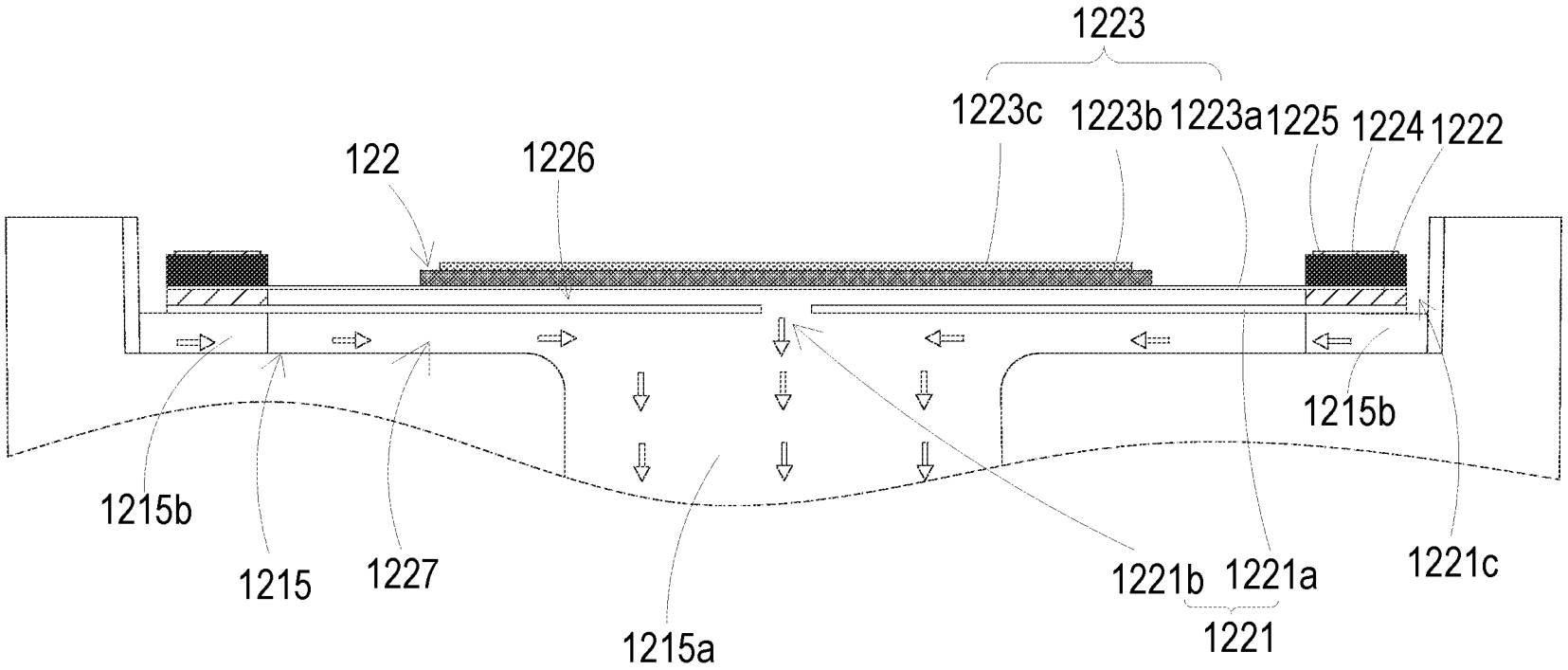
FIG. 9C is a schematic cross-sectional view (3) illustrating an action of the piezoelectric actuator according to the embodiment of the present disclosure.
Figure 10A:
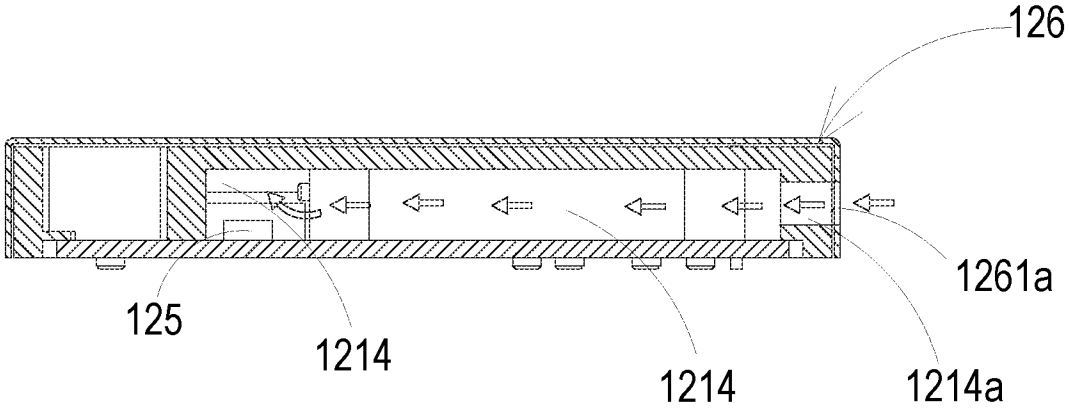
FIG. 10A is a schematic cross-sectional view (1) illustrating the gas detection main part according to the embodiment of the present disclosure.
Figure 10B:
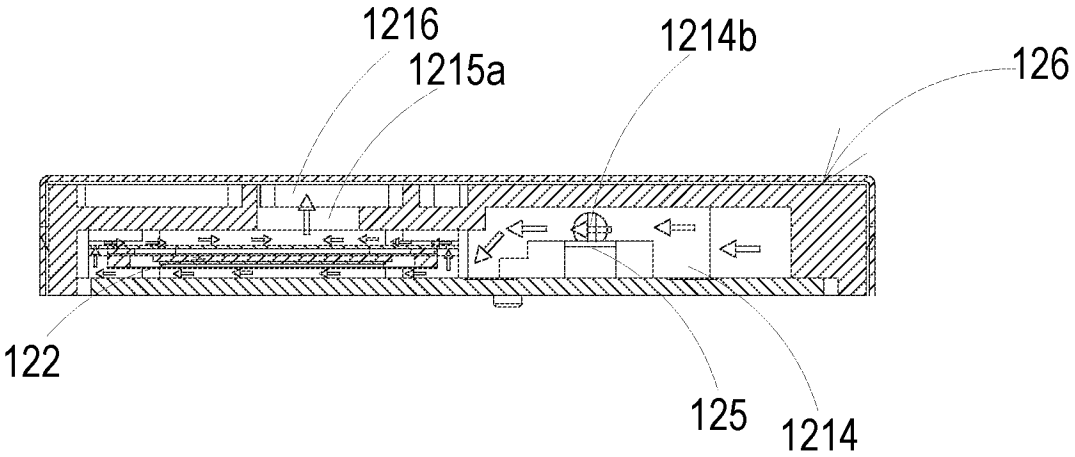
FIG. 10B is a schematic cross-sectional view (2) illustrating the gas detection main part according to the embodiment of the present disclosure.
Figure 10C:
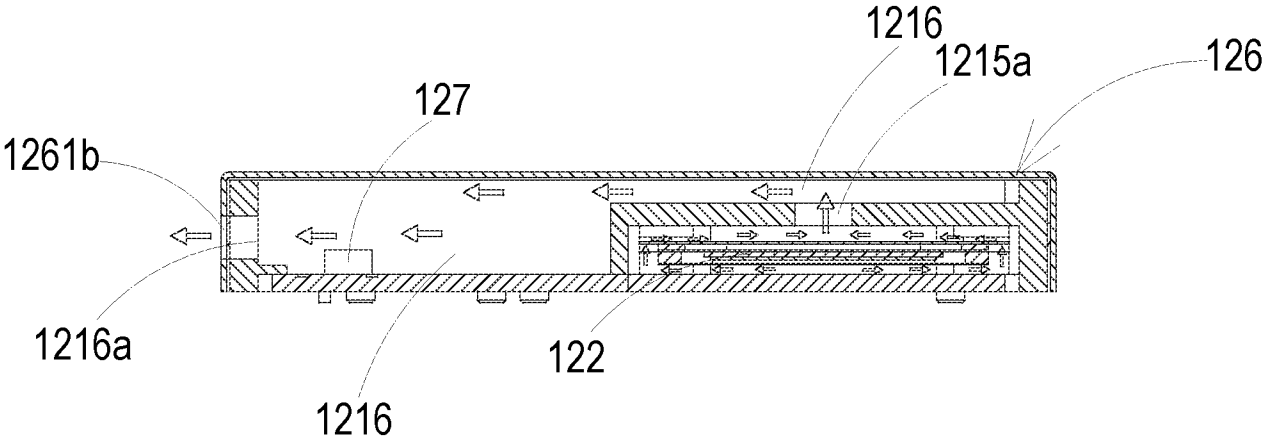
FIG. 10C is a schematic cross-sectional view (3) illustrating the gas detection main part according to the embodiment of the present disclosure.

By repeating the above operation steps shown in FIG. 9B and FIG. 9C, the piezoelectric plate 1223*c* is driven to generate the bending deformation in a reciprocating manner. According to the principle of inertia, since the gas pressure inside the resonance chamber 1226 is lower than the equilibrium gas pressure after the converged gas is ejected out, the gas is introduced into the resonance chamber 1226 again. Moreover, the vibration frequency of the gas in the resonance chamber 1226 is controlled to be close to the vibration frequency of the piezoelectric plate 1223*c*, so as to generate the Helmholtz resonance effect to achieve the gas transportation at high speed and in large quantities. The gas is inhaled through the gas-inlet 1214*a* on the outer cover 126, flows into the gas-inlet groove 1214 of the base 121 through the gas-inlet 1214*a*, and is transported to the position of the particulate sensor 125. The piezoelectric actuator 122 is enabled continuously to inhale the gas into the inlet path, and facilitate the gas outside the gas detection module to be introduced rapidly, flow stably, and transported above the particulate sensor 125. At this time, a projecting light beam emitted from the laser component 124 passes through the transparent window 1214*b* to irritate the suspended particles contained in the gas flowing above the particulate sensor 125 in the gas-inlet groove 1214. When the suspended particles contained in the gas are irradiated and generate scattered light spots, the scattered light spots are received and calculated by the particulate sensor 125 for obtaining related information about the sizes and the concentration of the suspended particles contained in the gas. Moreover, the gas above the particulate sensor 125 is continuously driven and transported by the piezoelectric actuator 122, flows into the ventilation hole 1215*a* of the gas-guiding-component loading region 1215, and is transported to the gas-outlet groove 1216. At last, after the gas flows into the gas outlet groove 1216, the gas is continuously transported into the gas-outlet groove 1216 by the piezoelectric actuator 122, and thus the gas in the gas-outlet groove 1216 is pushed to discharge through the gas-outlet 1216*a* and the outlet opening 1261*b*.

The gas detector 1 of the present disclosure not only can detect the particulate matters in the gas, but also can detect the gas characteristics of the introduced gas, for example, to determine whether the gas is formaldehyde, ammonia, carbon monoxide, carbon dioxide, oxygen, ozone, or the like. Therefore, in one or some embodiments, the gas detector 1 of the present disclosure further includes a gas sensor 127 positioned and disposed on the driving circuit board 123, electrically connected to the driving circuit board 123, and accommodated in the gas-outlet groove 1216, so as to detect the air pollution introduced into the gas-outlet groove 1216. Preferably but not exclusively, in an embodiment, the gas sensor 127 includes a volatile-organic-compound sensor for detecting the information of carbon dioxide ($CO_2$) or volatile organic compounds (TVOC). Preferably but not exclusively, in an embodiment, the gas sensor 127 includes a formaldehyde sensor for detecting the information of formaldehyde (HCHO) gas. Preferably but not exclusively, in an embodiment, the gas sensor 127 includes a bacteria sensor for detecting the information of bacteria or fungi. Preferably but not exclusively, in an embodiment, the gas sensor 127 includes a virus sensor for detecting the information of virus in the gas. Preferably but not exclusively, the gas sensor 127 is a temperature and humidity sensor for detecting the temperature and humidity information of the gas.

Figure 2A:
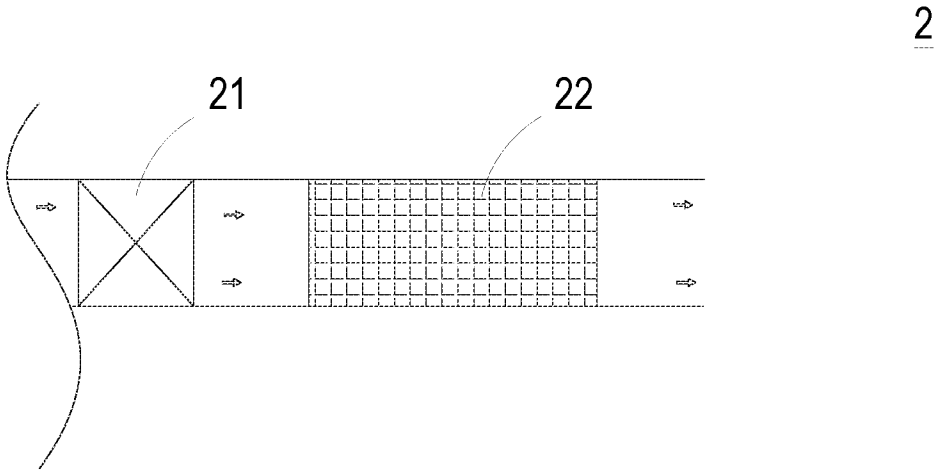
FIG. 2A is a schematic view illustrating the combination of the fan and the filter of the cleaning device according to the embodiment of the present disclosure.
Figure 2B:
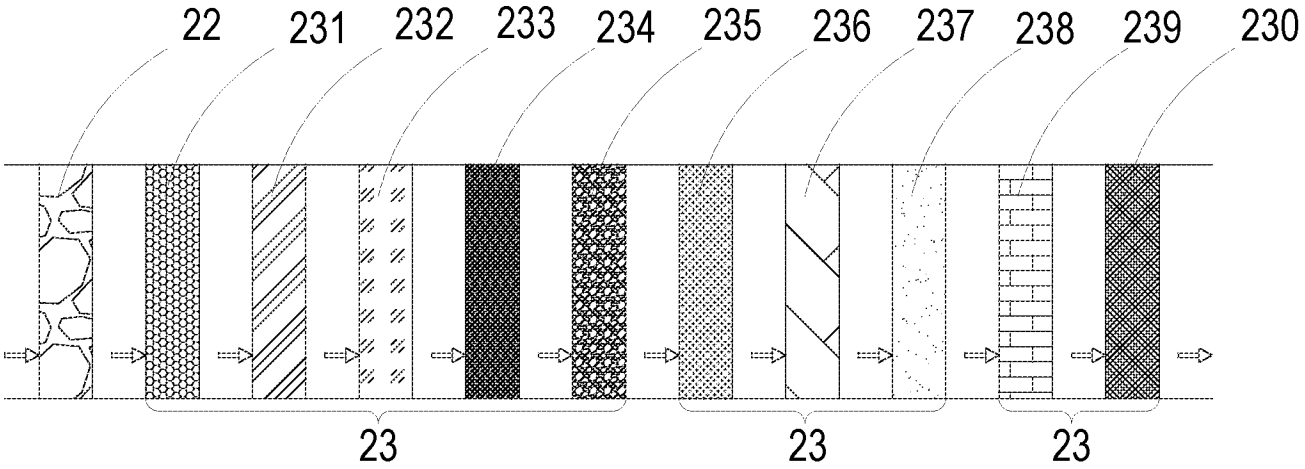
FIG. 2B is a schematic view illustrating the combination of the filter and the sterilization component of the cleaning device according to the embodiment of the present disclosure.

Please refer to FIG. 1, FIG. 2A and FIG. 2B. In the embodiment, the cleaning device 2 includes a fan 21, a filter 22 and a sterilization component 23. The fan 21 is controlled and enabled to guide the air pollution to pass through the filter 22 for filtration, and guide the air pollution to pass through the sterilization component 23 for sterilization. In the embodiment, the filter 22 includes a high efficiency particulate air (HEPA) filter screen, which is configured to absorb the chemical smoke, the bacteria, the dust particles and the pollen contained in the air pollution, so that the air pollution introduced into the filter 22 is filtered and purified to achieve the effect of filtering and purification. As shown in FIG. 2A, the airflow of the fan 21 flows in the path indicated by the arrow. The fan 21 can be arranged on the front side of the filter 22, and the fan 21 can also be arranged on the rear side of the filter 22. Notably, in the embodiment, the sterilization component 23 includes a decomposition layer coated on the filter 22 to sterilize in chemical means. Preferably but not exclusively, the decomposition layer includes an activated carbon 231 configured to remove organic and inorganic substances in air pollution, and remove colored and odorous substances. Preferably but not exclusively, the decomposition layer includes a cleansing factor containing chlorine dioxide layer 232 configured to inhibit viruses, bacteria, fungi, influenza A, influenza B, enterovirus and norovirus in the air pollution, and the inhibition ratio can reach 99% and more, thereby reducing the cross-infection of viruses. Preferably but not exclusively, the decomposition layer includes an herbal protective layer 233 extracted from ginkgo and Japanese *Rhus chinensis* configured to resist allergy effectively and destroy a surface protein of influenza virus (such as H1N1 influenza virus) passing therethrough. Preferably but not exclusively, the decomposition layer includes a silver ion 234 configured to inhibit viruses, bacteria and fungi contained in the air pollution. Preferably but not exclusively, the decomposition layer includes a zeolite 235 configured to remove ammonia nitrogen, heavy metals, organic pollutants, *Escherichia coli*, phenol, chloroform and anionic surfactants. Furthermore, in some embodiments, the sterilization component 23 includes a light irradiation element combined with the filter 22 to sterilize in chemical means. Preferably but not exclusively, the light irradiation element is a photo-catalyst unit including a photo catalyst 236 and an ultraviolet lamp 237. When the photo catalyst 236 is irradiated by the ultraviolet lamp 237, the light energy is converted into the chemical energy, thereby decomposes harmful gases and disinfects bacteria contained in the air pollution, so as to achieve the effects of filtering and purifying. Preferably but not exclusively, the light irradiation element is a photo-plasma unit including a nanometer irradiation tube 238. When the introduced air pollution is irradiated by the nanometer irradiation tube 238, the oxygen molecules and water molecules contained in the air pollution are decomposed into high oxidizing photo-plasma, and an ion flow capable of destroying organic molecules is generated. In that, volatile formaldehyde, volatile toluene and volatile organic compounds (VOC) contained in the air pollution are decomposed into water and carbon dioxide, so as to achieve the effects of filtering and purifying. Moreover, in some embodiments, the sterilization component 23 includes a decomposition unit combined with the filter 22 to sterilized in chemical means. Preferably but not exclusively, the decomposition unit is a negative ion unit 239 with s a dust collecting plate. It makes the suspended particles in the air pollution to carry with positive charge and adhered to the dust collecting plate carry with negative charges, so as to achieve the effects of filtering and purifying. Preferably but not exclusively, the decomposition unit is a plasma ion unit 230. The oxygen molecules and water molecules contained in the air pollution are decomposed into positive hydrogen ions ($H^+$) and negative oxygen ions ($O^{2-}$) by the plasma ion. The substances attached with water around the ions are adhered on the surface of viruses and bacteria and converted into OH radicals with extremely strong oxidizing power, thereby removing hydrogen (H) from the protein on the surface of viruses and bacteria, and thus decomposing (oxidizing) the protein, so as to filter the introduced air pollution and achieve the effects of filtering and purifying.

Figure 11:
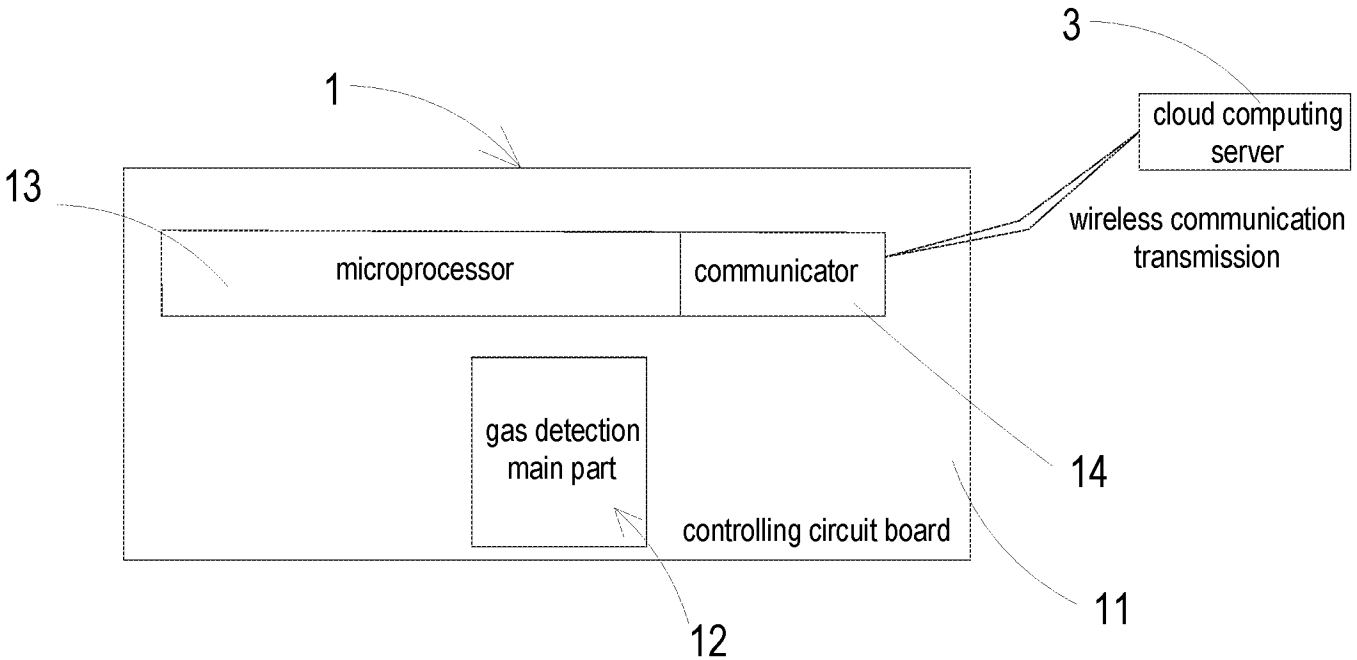
FIG. 11 is a schematic diagram illustrating the communication transmission of the gas detector according to the embodiment of the present invention.

Please refer to FIG. 1 and FIG. 11. The gas detector 1 is directly installed in the cleaning device 2, and the gas detection module of the cleaning device 2 is configured to connect the power supply and the controlling and driving circuit, so that the communicator 14 of the gas detection module and the cloud computing server 3 are in data communication with each other. A control commend is issued to control the enablement of the fan 21 of the cleaning device 2 and adjust the air volume of the fan by the cloud computing server 3. Therefore, the actuation, time period and speed of the fan 21 of the cleaning device 2 can be controlled and adjusted according to the air pollution information at any time to filter the air pollution and perform the sterilization and purification.

Figure 12:
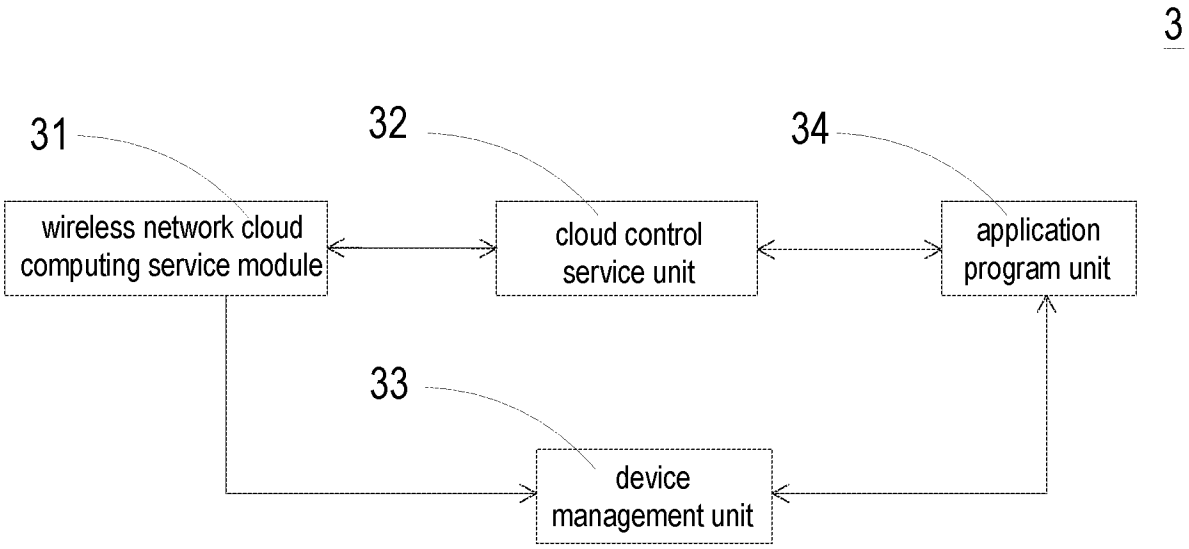
FIG. 12 is a schematic diagram of the architecture of the cloud computing server according to the embodiment of the present disclosure.

Please refer to FIG. 12. In the embodiment, the cloud computing server 3 includes a wireless network cloud computing service module 31, a cloud control service unit 32, a device management unit 33 and an application program unit 34. The wireless network cloud computing service module 31 receives the air pollution information of the indoor field A, receives the communication information of the cleaning device 2 and transmits the control commands. Moreover, the wireless network cloud computing service module 31 receives the air pollution information of the indoor field A and transmits it to the cloud control service unit 32 to store and form an air pollution database. An artificial intelligence calculation is implemented to determine the location of the air pollution through the air pollution database comparison, so that the control commend is transmitted to the wireless network cloud computing service module 31, and then transmitted to the fan 21 of the cleaning device 2 to control the actuation operation through the wireless network cloud computing service module 31. The device management unit 33 receives the communication information of the cleaning device 2 through the wireless network cloud computing service module 31 to manage the user login and device binding. The device management information can be provided to the application program unit 34 for system control and management, and the application program unit 34 can also display and inform the air pollution information obtained by the cloud control service unit 32. The user can know the real-time status of air pollution removal through the mobile phone or the communication device. Moreover, the user can control the operation of the indoor air cleaning system through the application program unit 34 of the mobile phone or the communication device.

In view of the above description of the present disclosure, at least one gas detector 1 and at least one cleaning device 2 are disposed in the indoor field A, so that the gas detector 1 can monitor and determine the air pollution at any time, and output the air pollution information. Then, the air pollution information can be received through the cloud computing server 3 and stored in an air pollution database of data. Furthermore, an artificial intelligence calculation is implemented to determine the location of air pollution, and a control command is issued to transmit to the actuation operation of the cleaning device 2. Whereby, a directional circular airflow is generated in the indoor field A, and the air pollution is rapidly guided to pass through the cleaning device 2 multiple times for filtration, complete purification and sterilization. Through the detecting-cleaning prevention effectiveness of locating the air pollution, guiding the air pollution, and complete purifying the air pollution in the indoor field A, the gas state of the indoor field A can reach the cleanliness of clean room class.

Notably, the air pollution safety detection value is determined through the stored air pollution database and the intelligent calculation of the cloud computing server 3, and then the control command is transmitted to the cleaning device 2 for the actuation operation. Preferably but not exclusively, the safety detection value includes at least one selected from the group consisting of a concentration of PM2.5 which is less than 10 $\mu g/m^3$, a concentration of carbon dioxide ($CO_2$) which is less than 1000 ppm, a concentration of total volatile organic compounds (TVOC) which is less than 0.56 ppm, a concentration of formaldehyde (HCHO) which is less than 0.08 ppm, a colony-forming unit of bacteria which is less than 1500 $CFU/m^3$, a colony-forming unit of fungi which is less than 1000 $CFU/m^3$, a concentration of sulfur dioxide which is less than 0.075 ppm, a concentration of nitrogen dioxide which is less than 0.1 ppm, a concentration of carbon monoxide which is less than 9 ppm, a concentration of ozone which is less than 0.06 ppm, and a concentration of lead which is less than 0.15 $\mu g/m^3$.

Certainly, the indoor air cleaning system of the present disclosure can be applied to the indoor field A of home and office. In order to make the gas state of the indoor field A reach the cleanliness of the clean room class, it is different from the positive pressure type clean rooms used in the general semiconductor industry, or the negative-pressure clean rooms used in the hospitals, and biotechnology plants. In addition to the filter 22 with the HEPA filter screen used to filter the air pollution, the fan 21 has a specific clean air delivery rate (CADR), the directional circular airflow is generated continuously in the indoor field A, and the air pollution is rapidly guided to pass through the filter 22 multiple times for filtration and complete purification and through the sterilization component 23 for sterilization, so that the indoor space field A can meet the requirements of the clean room, and the impact and injury of human health caused by the gas hazards in the environment can be avoided. It allows the indoor field of the home and the office to achieve the required cleanliness of clean room class at a price lower than ¼~⅒ of the cost of setting up the positive-pressure clean room in the general semiconductor industry or the negative-pressure clean room in the hospitals or a biotechnology plants. It is extremely industrially applicable.

In the following, several specific embodiments are described. As shown in FIG. 13, the present disclosure formulates a comparison table of the cleanliness of clean room classes relative to the required grades for the air pollution of the indoor space field, so as to illustrate the gas state of the indoor field A and the cleanliness of clean room class achieved by the air cleaning system of the present disclosure. The number of suspended particles in the air pollution of the indoor space field is used to distinguish their classifications, and the suspended particles ≥0.5 μm in per one cubic meter are accounted. Notably, the clean room class 1 to class 9 in the comparison table are completely the same as the ISO standard clean room class 1 to class 9, and the clean room class 10 to class 20 are also standardized.

In a specific embodiment, the filter 22 is a nanometer filter, the fan 21 of the cleaning device 2 having the specific CADR of the fan greater than CADR 1500 is actuated to generate the directional circular airflow in the indoor field A, and the air pollution of the indoor filed A is rapidly guided to pass through the filter 22 multiple times for filtration and complete purification and through the sterilization component 23 for sterilization, so that the gas state in the indoor field A reaches the cleanliness of clean room class 1. Notably, the nanometer filter is one selected from the group consisting of a nano fiber, a nano activated carbon, a nano film and a combination thereof.

In a specific embodiment, the filter 22 includes an ultra low particulate air (ULPA) filter of U17, the fan 21 of the cleaning device 2 having the specific CADR of the fan greater than CADR 1500 is actuated to generate the directional circular airflow in the indoor field A, and the air pollution of the indoor field A is rapidly guided to pass through the filter 22 multiple times for filtration and complete purification and through the sterilization component 23 for sterilization, so that the gas state in the indoor field A reaches the cleanliness of clean room class 2.

In a specific embodiment, the filter 22 includes an ultra low particulate air (ULPA) filter of U16, the fan 21 of the cleaning device 2 having the specific CADR of the fan greater than CADR 1000 is actuated to generate the directional circular airflow in the indoor field A, and the air pollution of the indoor field A is rapidly guided to pass through the filter 22 multiple times for filtration and complete purification and through the sterilization component 23 for sterilization, so that the gas state in the indoor field A reaches the cleanliness of clean room class 3.

In a specific embodiment, the filter 22 includes an ultra low particulate air (ULPA) filter of U15, the fan 21 of the cleaning device 2 having the specific CADR of the fan greater than CADR 1000 is actuated to generate the directional circular airflow in the indoor field A, and the air pollution of the indoor field A is rapidly guided to pass through the filter 22 multiple times for filtration and complete purification and through the sterilization component 23 for sterilization, so that the gas state in the indoor field A reaches the cleanliness of clean room class 4 to class 5.

In a specific embodiment, the filter 22 includes a high efficiency particulate air (HEPA) filter of H14, the fan 21 of the cleaning device 2 having the specific CADR of the fan greater than CADR 600 is actuated to generate the directional circular airflow in the indoor field A, and the air pollution of the indoor field A is rapidly guided to pass through the filter 22 multiple times for filtration and complete purification and through the sterilization component 23 for sterilization, so that the gas state in the indoor field A reaches the cleanliness of clean room class 6.

In a specific embodiment, the filter comprises a high efficiency particulate air (HEPA) filter of H13, the fan of the cleaning device having the specific CADR of the fan greater than CADR 600 is actuated to generate the directional circular airflow in the indoor field, and the air pollution is rapidly guided to pass through the filter multiple times for filtration and complete purification and through the sterilization component for sterilization, so that the gas state in the indoor field reaches the cleanliness of clean room class 7 to class 8.

In a specific embodiment, the filter 22 includes a high efficiency particulate air (HEPA) filter of H12, the fan 21 of the cleaning device 2 having the specific CADR of the fan greater than CADR 600 is actuated to generate the directional circular airflow in the indoor field A, and the air pollution of the indoor field A is rapidly guided to pass through the filter 22 multiple times for filtration and complete purification and through the sterilization component 23 for sterilization, so that the gas state in the indoor field A reaches the cleanliness of clean room class 9.

In a specific embodiment, the filter 22 includes a high efficiency particulate air (HEPA) filter of H12, the fan 21 of the cleaning device 2 having the specific CADR of the fan less than CADR 600 is actuated to generate the directional circular airflow in the indoor field A, and the air pollution of the indoor field A is rapidly guided to pass through the filter 22 multiple times for filtration and complete purification and through the sterilization component 23 for sterilization, so that the gas state in the indoor field A reaches the cleanliness of clean room class 10 to class 11.

In a specific embodiment, the filter 22 includes a high efficiency particulate air (HEPA) filter of H11, the fan 21 of the cleaning device 2 having the specific CADR of the fan less than CADR 600 is actuated to generate the directional circular airflow in the indoor field A, and the air pollution of the indoor field A is rapidly guided to pass through the filter 22 multiple times for filtration and complete purification and through the sterilization component 23 for sterilization, so that the gas state in the indoor field A reaches the cleanliness of clean room class 12 to class 15.

In a specific embodiment, the filter 22 includes a high efficiency particulate air (HEPA) filter of H10, the fan 21 of the cleaning device 2 having the specific CADR of the fan less than CADR 600 is actuated to generate the directional circular airflow in the indoor field A, and the air pollution of the indoor field A is rapidly guided to pass through the filter 22 multiple times for filtration and complete purification and through the sterilization component 23 for sterilization, so that the gas state in the indoor field A reaches the cleanliness of clean room class 16 to class 20.

In summary, the present disclosure provides an indoor air cleaning system. By disposing at least one gas detector and at least one cleaning device, the gas detector can monitor and determine the air pollution at any time, and output an air pollution information. Then the cloud computing server receives the air pollution information, stores the air pollution information to an air pollution database, implements artificial intelligence calculation to determine the location of the air pollution position, and issues a control command to the cleaning device for the actuation operation, so that a directional circular airflow is generated, and the air pollution is rapidly guided to pass through the cleaning device multiple times for filtration, complete purification and sterilization. Through the detecting-cleaning prevention effectiveness of locating the air pollution, guiding the air pollution, and complete purifying the air pollution in the indoor field, the gas state of the indoor field can reach a cleanliness of clean room class. Different from the positive pressure type clean rooms used in the general semiconductor industry, or the negative-pressure clean rooms used in the hospitals, and biotechnology plants, the indoor air cleaning system of the present disclosure uses the filter with the HEPA filter screen to filter the air pollution, the fan has a specific clean air delivery rate (CADR) for generating a directional circular airflow, and the directional circular airflow is generated continuously in the indoor field. Whereby, the air pollution is rapidly guided to pass through the filter multiple times for filtration and complete purification and through the sterilization component for sterilization, so that the indoor space field can meet the requirements of the clean room, and the impact and injury of human health caused by the gas hazards in the environment can be avoided. It allows the indoor field of the home and the office to achieve the required cleanliness of clean room class at a price lower than ¼~1/10 of the cost of setting up the positive-pressure clean room in the general semiconductor industry or the negative-pressure clean room in the hospitals or a biotechnology plants. The present disclosure includes the industrial applicability and the inventive steps.

What is claimed is:

1. An indoor air cleaning system, comprising:

at least one gas detector disposed in an indoor field for detecting air pollution and outputting to form air pollution information;

at least one cleaning device comprising a fan, a filter and a sterilization component, wherein the fan is enabled to guide the air pollution to pass through the filter for filtration, and pass through the sterilization component for sterilization, wherein the fan has a specific clean air delivery rate (CADR) for generating a directional circular airflow, and the filter comprises a high efficiency particulate air (HEPA) filter screen; and a cloud computing server receiving the air pollution information, storing the air pollution information to a database, and intelligently computing and selecting according to the air pollution information to determine the location of the air pollution and output a control command to the fan of the cleaning device for actuation operation, whereby the fan of the cleaning device generates the directional circular airflow, and the air pollution is guided to repeatedly pass through the filter for filtration and complete purification and through the sterilization component for sterilization, so that gas state in the indoor field reaches a cleanliness of clean room class.

2. The indoor air cleaning system according to claim 1, wherein the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

3. The indoor air cleaning system according to claim 1, wherein the specific CADR of the fan is greater than CADR 1500, the filter is a nanometer filter, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches the cleanliness of clean room class 1.

4. The indoor air cleaning system according to claim 3, wherein the nanometer filter comprises at least one selected from the group consisting of a nano fiber, a nano activated carbon, a nano film and a combination thereof.

5. The indoor air cleaning system according to claim 1, wherein the specific CADR of the fan is greater than CADR 1500, the filter comprises an ultra low particulate air (ULPA) filter of U17, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches the cleanliness of clean room class 2.

6. The indoor air cleaning system according to claim 1, wherein the specific CADR of the fan is greater than CADR 1000, the filter comprises an ultra low particulate air (ULPA) filter of U16, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches the cleanliness of clean room class 3.

7. The indoor air cleaning system according to claim 1, wherein the specific CADR of the fan is greater than CADR 1000, the filter comprises an ultra low particulate air (ULPA) filter of U15, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches the cleanliness of clean room class 4 to class 5.

8. The indoor air cleaning system according to claim 1, wherein the specific CADR of the fan is greater than CADR 600, the filter comprises a high efficiency particulate air (HEPA) filter of H14, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches the cleanliness of clean room class 6.

9. The indoor air cleaning system according to claim 1, wherein the specific CADR of the fan is greater than CADR 600, the filter comprises a high efficiency particulate air (HEPA) filter of H13, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches the cleanliness of clean room class 7 to class 8.

10. The indoor air cleaning system according to claim 1, wherein the specific CADR of the fan is greater than CADR 600, the filter comprises a high efficiency particulate air (HEPA) filter of H12, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches the cleanliness of clean room class 9.

11. The indoor air cleaning system according to claim 1, wherein the specific CADR of the fan is less than CADR 600, the filter comprises a high efficiency particulate air (HEPA) filter of H12, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches the cleanliness of clean room class 10 to class 11.

12. The indoor air cleaning system according to claim 1, wherein the specific CADR of the fan is less than CADR 600, the filter comprises a high efficiency particulate air (HEPA) filter of H11, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches below the cleanliness of clean room class 12 to class 15.

13. The indoor air cleaning system according to claim 1, wherein the specific CADR of the fan is less than CADR 600, the filter comprises a high efficiency particulate air (HEPA) filter of H10, the fan of the cleaning device is actuated to generate the directional circular airflow in the indoor field, and the air pollution is guided to repeatedly pass through the filter for filtration and complete purification and through the sterilization component for sterilization, so that the gas state in the indoor field reaches below the cleanliness of clean room class 16 to class 20.

14. The indoor air cleaning system according to claim 1, wherein the sterilization component comprises a decomposition layer coated on the filter, wherein the layer decomposition layer uses chemical means to sterilize.

15. The indoor air cleaning system according to claim 14, wherein the sterilization component comprises a decomposition layer coated on the filter, wherein the layer decomposition layer comprises at least one selected from the group consisting of an activated carbon, a cleansing factor containing chlorine dioxide layer, an herbal protective layer extracted from ginkgo and Japanese *Rhus chinensis*, a silver ion, a zeolite and a combination thereof.

16. The indoor air cleaning system according to claim 1, wherein the sterilization component comprises at least one selected from the group consisting of a light irradiation element, a decomposition unit and a combination thereof, which is combined with the filter to sterilize in chemical means.

17. The indoor air cleaning system according to claim 16, wherein the light irradiation element is at least one selected from the group consisting of a photo-catalyst unit comprising a photo catalyst and an ultraviolet lamp, a photo-plasma unit comprising a nanometer irradiation tube and a combination thereof.

18. The indoor air cleaning system according to claim 16, wherein the decomposition unit is at least one selected from the group consisting of a negative ion unit, a plasma ion unit and a combination thereof.

19. The indoor air cleaning system according to claim 1, wherein the cloud computing server comprises a wireless network cloud computing service module, a cloud control service unit, a device management unit and an application program unit, wherein the gas detector comprises a controlling circuit board, a gas detection main part, a microprocessor and a communicator, and the gas detection main part, the microprocessor and the communicator are integrally packaged on the controlling circuit board and electrically connected to the controlling circuit board, wherein the microprocessor controls the detection of the gas detection main part, the gas detection main part detects the air pollution and outputs the air pollution information, and the microprocessor receives, processes and provides the air pollution information to the communicator for a wireless communication transmission externally.

20. The indoor air cleaning system according to claim 19, wherein the wireless communication transmission is one selected from the group consisting of a Wi-Fi communication transmission, a Bluetooth communication transmission, a radio frequency identification communication transmission and a near field communication (NFC) transmission.

21. The indoor air cleaning system according to claim 19, wherein the gas detection main part comprises:

a base comprising:

a first surface;

a second surface opposite to the first surface;

a laser loading region hollowed out from the first surface to the second surface;

a gas-inlet groove concavely formed from the second surface and disposed adjacent to the laser loading region, wherein the gas-inlet groove comprises a gas-inlet and two lateral walls, the gas-inlet is in communication with an environment outside the base, and a transparent window is opened on the two lateral walls and is in communication with the laser loading region;

a gas-guiding-component loading region concavely formed from the second surface and in communication with the gas-inlet groove, wherein a ventilation hole penetrates a bottom surface of the gas-guiding-component loading region; and a gas-outlet groove concavely formed from the first surface, spatially corresponding to the bottom surface of the gas-guiding-component loading region, and hollowed out from the first surface to the second surface in a region where the first surface is not aligned with the gas-guiding-component loading region, wherein the gas-outlet groove is in communication with the ventilation hole, and a gas-outlet is disposed in the gas-outlet groove;

a piezoelectric actuator accommodated in the gas-guiding-component loading region;

a driving circuit board covering and attached to the second surface of the base;

a laser component positioned and disposed on the driving circuit board, electrically connected to the driving circuit board, and accommodated in the laser loading region, wherein a light beam path emitted from the laser component passes through the transparent window and extends in a direction perpendicular to the gas-inlet groove, thereby forming an orthogonal direction with the gas-inlet groove;

a particulate sensor positioned and disposed on the driving circuit board, electrically connected to the driving circuit board, and disposed at an orthogonal position where the gas-inlet groove intersects the light beam path of the laser component in the orthogonal direction, so that suspended particles contained in the air pollution passing through the gas-inlet groove and irradiated by a projecting light beam emitted from the laser component are detected;

a gas sensor positioned and disposed on the driving circuit board, electrically connected to the driving circuit board, and accommodated in the gas-outlet groove, so as to detect the air pollution introduced into the gas-outlet groove; and an outer cover covering the base and comprising a side plate, wherein the side plate has an inlet opening and an outlet opening, the inlet opening is spatially corresponding to the gas-inlet of the base, and the outlet opening is spatially corresponding to the gas-outlet of the base;

wherein the outer cover covers the base, and the driving circuit board covers the second surface, thereby an inlet path is defined by the gas-inlet groove, and an outlet path is defined by the gas-outlet groove, so that the air pollution is inhaled from the environment outside the base by the piezoelectric actuator, transported into the inlet path defined by the gas-inlet groove through the inlet opening, and passes through the particulate sensor to detect the particle concentration of the suspended particles contained in the air pollution, and the air pollution transported through the piezoelectric actuator is transported out of the outlet path defined by the gas-outlet groove through the ventilation hole, passes through the gas sensor for detecting, and then pushed to discharge through the gas-outlet of the base and the outlet opening.

22. The indoor air cleaning system according to claim 21, wherein the particulate sensor is used for detecting information of the suspended particulate.

23. The indoor air cleaning system according to claim 21, wherein the gas sensor comprises one selected from the group consisting of a volatile-organic-compound sensor, a formaldehyde sensor, a bacteria sensor, a virus sensor and a combination thereof, wherein the volatile-organic-compound sensor detects information of carbon dioxide or total volatile organic compounds, the formaldehyde sensor detects information of formaldehyde, the bacteria sensor detects information of bacteria or fungi, and the virus sensor detecting information of virus.

* * * * *